US010358987B2

(12) United States Patent
Reyenga et al.

(10) Patent No.: US 10,358,987 B2
(45) Date of Patent: Jul. 23, 2019

(54) BUTTERFLY BYPASS VALVE, AND THROTTLE LOSS RECOVERY SYSTEM INCORPORATING SAME

(71) Applicant: HONEYWELL INTERNATIONAL INC., Morristown, NJ (US)

(72) Inventors: James William Reyenga, Long Beach, CA (US); Mike Guidry, Redondo Beach, CA (US); Patrick Beresewicz, La Mirada, CA (US)

(73) Assignee: Garrett Transportation I Inc., Torrance, CA (US)

( * ) Notice: Subject to any disclaimer, the term of this patent is extended or adjusted under 35 U.S.C. 154(b) by 534 days.

(21) Appl. No.: 14/387,877

(22) PCT Filed: Apr. 23, 2013

(86) PCT No.: PCT/US2013/037711
§ 371 (c)(1),
(2) Date: Sep. 25, 2014

(87) PCT Pub. No.: WO2013/163128
PCT Pub. Date: Oct. 31, 2013

(65) Prior Publication Data

US 2015/0040860 A1 Feb. 12, 2015

Related U.S. Application Data

(60) Provisional application No. 61/637,038, filed on Apr. 23, 2012.

(51) Int. Cl.

| | |
|---|---|
| ***F02D 9/08*** | (2006.01) |
| ***F02D 9/10*** | (2006.01) |
| ***F02D 9/02*** | (2006.01) |

(52) U.S. Cl.
CPC ..... *F02D 9/10* (2013.01); *F02D 9/02* (2013.01); *F02D 9/1015* (2013.01);
(Continued)

(58) Field of Classification Search
CPC ..... F02D 9/1055; F02D 9/10; F02D 9/1015; F05D 2260/606
(Continued)

(56) References Cited

U.S. PATENT DOCUMENTS

| | | | |
|---|---|---|---|
| 3,356,289 | A | 12/1967 | Plotkowiak |
| 3,756,739 | A | 9/1973 | Boussuges |

(Continued)

FOREIGN PATENT DOCUMENTS

| | | | |
|---|---|---|---|
| CN | 24693 | Y | 1/2002 |
| DE | 3205722 | A1 | 8/1983 |

(Continued)

OTHER PUBLICATIONS

Eichhorn, et al., "Throttle Loss Recovery Using a Variable Geometry Turbine," SAE International, published May 5, 2010, 19 pages.

(Continued)

*Primary Examiner* — Marguerite J McMahon
*Assistant Examiner* — James J Kim
(74) *Attorney, Agent, or Firm* — John C. James

(57) ABSTRACT

A butterfly bypass valve includes a housing defining a bypass flow passage with a pivotable throttle plate therein. An outer edge of the throttle plate in a closed position is in sealing engagement with a sealing portion of the housing such that the throttle plate restricts fluid flow through the bypass flow passage. The throttle plate is pivotable to an open position to allow fluid flow through the bypass flow passage. A port in the housing allows a portion of fluid passing through the bypass flow passage to be removed when the throttle plate is pivoted to the open position. A (Continued)

predetermined amount of pivoting of the throttle plate toward the open position can occur so as to allow flow through the port, while maintaining the edge of the throttle plate in substantially sealing engagement with the sealing portion so as to substantially prevent flow through the bypass passage.

11 Claims, 18 Drawing Sheets

(52) U.S. Cl.
CPC .... *F02D 9/1055* (2013.01); *F02D 2009/0201* (2013.01); *F02D 2009/0283* (2013.01); *F05D 2220/40* (2013.01); *F05D 2220/62* (2013.01)

(58) Field of Classification Search
USPC ..... 123/337, 339.23; 60/396, 397; 137/1
See application file for complete search history.

(56) References Cited

U.S. PATENT DOCUMENTS

| | | | | |
|---|---|---|---|---|
| 4,177,005 | A | 12/1979 | Bozung et al. | |
| 4,439,983 | A | 4/1984 | Gertz | |
| 4,700,542 | A | 10/1987 | Wang | |
| 5,092,126 | A | 3/1992 | Yano | |
| 5,394,848 | A | 3/1995 | Tsutsumi et al. | |
| 5,544,484 | A | 8/1996 | Voss et al. | |
| 5,559,379 | A | 9/1996 | Voss | |
| 5,818,117 | A | 10/1998 | Voss et al. | |
| 5,904,405 | A | 5/1999 | Kapich | |
| 6,050,775 | A | 4/2000 | Erdmann et al. | |
| 6,094,909 | A | 8/2000 | Weber et al. | |
| 6,276,139 | B1 | 8/2001 | Moraal et al. | |
| 6,584,963 | B2 | 7/2003 | Arnold | |
| 6,634,334 | B1 * | 10/2003 | Hwang | F02D 9/02 123/337 |
| 6,817,173 | B2 | 11/2004 | Paffrath et al. | |
| 6,843,224 | B2 * | 1/2005 | Ha | F02B 31/00 123/337 |
| 6,901,919 | B2 * | 6/2005 | Namari | F02D 35/003 123/339.23 |
| 7,152,393 | B2 | 12/2006 | Hergemoller et al. | |
| 8,446,029 | B2 * | 5/2013 | Smith | F01D 1/30 290/52 |
| 8,544,262 | B2 * | 10/2013 | Reyenga | F01D 15/10 60/397 |
| 8,763,385 | B2 * | 7/2014 | Leone | F02D 11/10 123/1 R |
| 2002/0089310 | A1 | 7/2002 | Shimizu et al. | |
| 2003/0014973 | A1 | 1/2003 | Mazaua et al. | |
| 2003/0140630 | A1 | 7/2003 | Baeuerle et al. | |
| 2003/0167751 | A1 | 9/2003 | Paffrath et al. | |
| 2004/0187852 | A1 | 9/2004 | Kawamura et al. | |
| 2004/0250539 | A1 | 12/2004 | Cueman et al. | |
| 2005/0150210 | A1 | 7/2005 | Thorsten et al. | |
| 2006/0138995 | A1 | 6/2006 | Sugita et al. | |
| 2007/0007771 | A1 | 1/2007 | Biddle et al. | |
| 2007/0033939 | A1 | 2/2007 | Wang et al. | |
| 2007/0062192 | A1 | 3/2007 | Weber et al. | |
| 2007/0107429 | A1 | 5/2007 | Squires | |
| 2008/0031750 | A1 | 2/2008 | Gomilar et al. | |
| 2008/0095610 | A1 | 4/2008 | Bosen | |
| 2008/0230618 | A1 | 9/2008 | Gawthrop | |
| 2009/0060719 | A1 | 3/2009 | Haugen | |
| 2010/0060013 | A1 | 3/2010 | Csefko | |
| 2011/0094230 | A1 | 4/2011 | Finkenrath et al. | |
| 2011/0100010 | A1 | 5/2011 | Freund et al. | |
| 2011/0241344 | A1 | 10/2011 | Smith et al. | |
| 2011/0265882 | A1 | 11/2011 | Reyenga et al. | |
| 2011/0271936 | A1 | 11/2011 | Reyenga et al. | |
| 2012/0107089 | A1 | 5/2012 | Vaidyanathan et al. | |
| 2014/0041623 | A1 | 2/2014 | Beresewicz et al. | |

FOREIGN PATENT DOCUMENTS

| | | | |
|---|---|---|---|
| DE | 19651647 | A1 | 6/1998 |
| DE | 19937781 | A1 | 2/2001 |
| EP | 0147740 | A2 | 12/1984 |
| EP | 0344902 | A2 | 12/1989 |
| EP | 0360569 | A2 | 3/1990 |
| EP | 0609674 | A2 | 8/1994 |
| EP | 1088975 | A1 | 4/2001 |
| EP | 1158141 | A2 | 11/2001 |
| EP | 0770189 | B1 | 2/2002 |
| EP | 1365140 | A2 | 11/2003 |
| EP | 1722080 | A2 | 11/2006 |
| GB | 2457326 | A | 8/2009 |
| JP | 51-143122 | A | 12/1976 |
| JP | 01-227803 | A | 9/1989 |
| JP | 04-241704 | A | 8/1992 |
| JP | 05-332158 | A | 12/1993 |
| JP | 06213107 | A | 8/1994 |
| JP | 2004-308646 | A | 11/2004 |
| JP | 2005-188348 | A | 7/2005 |
| JP | 2006-105075 | A | 4/2006 |
| JP | 2006-214325 | A | 8/2006 |
| JP | 2008-157150 | A | 7/2008 |
| KR | 2006-0055430 | A | 5/2006 |
| KR | 2006-0074848 | A | 7/2006 |
| NL | 1022429 | C1 | 7/2004 |
| WO | 92/09800 | A1 | 6/1992 |
| WO | 96/04487 | A1 | 2/1996 |
| WO | 97/38212 | A1 | 10/1997 |
| WO | 01/11208 | A1 | 2/2001 |
| WO | 2009/092670 | A1 | 7/2009 |
| WO | 2010/043910 | A1 | 4/2010 |
| WO | 2011/139725 | A2 | 11/2011 |

OTHER PUBLICATIONS

Guzzella, et 21].; Swiss Federal Institute of Technology; Recuperative Throttling of SI Engines for Improved Fuel Economy; 2001-OI-0514; 2004 SAE International (6 pgs.).

Muller, et al.; DaimlerChrysler AG, Research Body and Powertrain and University of Karlsruhe, Institute for Thermal Turbomachinery; Using the Centrifugal Compressor as a ColdAir Turbine; 2006 DaimlerChrysler AG; pp. 1-13.

Onder, et al.; Measurement and Control Laboratory, Swiss Federal Institute of Technology; Modelling and Control of an Active Throttle for SI Engines; IFAC Advances in Automotive Control; Salerno, Italy, 2004; pp. 155-160.

Tomic, et al.; University of Belgrade, Faculty of Mechanical Engineering; Spark Ignition Engine Part Load Fuel Economy Improvement: Numerical Consideration; FME Transactions (2003); pp. 21-26 ; vol. 31, No. 1.

Eichhorn, R.H.L.; Boot, M.D.; Luijten, C.C.M.; Waste Energy Driven Air Conditioning Systems (WEDACS); Copyright 2009 SAE International; pp. 1-16.

* cited by examiner

BUTTERFLY BYPASS VALVE, AND THROTTLE LOSS RECOVERY SYSTEM INCORPORATING SAME

BACKGROUND OF THE INVENTION

1. Field of the Invention

The present application relates generally to throttle loss recovery systems for internal combustion engines, and relates more particularly to a butterfly bypass valve useful in such systems as well as in other applications.

2. Description of Related Art

The power output of spark ignition engines, as well as some diesel engines, generally is controlled by a throttle plate or butterfly valve whose position is governed by the setting of the accelerator pedal or the like. As the throttle plate is moved to narrow the flow passage for the intake air, the air flow rate is reduced, which reduces the torque and power output from the engine, and correspondingly the air is expanded (i.e., loses pressure) before reaching the engine intake manifold. This throttling of the intake air causes a loss in overall engine efficiency because in effect the engine must work harder to pull the air through the restricted throttle.

Thus, throttle loss recovery (TLR) systems, typically turbine-generator systems, have been developed that seek to regulate the flow of intake air while recovering some of the energy lost in the throttling process. During at least some engine operating conditions, the air destined for the engine intake manifold first passes through a turbine that expands the air and drives an electrical generator. Thus, the turbine acts as the throttle during such conditions. However, these prior systems have often failed to satisfactorily address the issue of controllability, specifically, how to ensure that the total air flow rate into the intake manifold responds to the driver's demanded power (i.e., accelerator pedal position) in an appropriate way.

BRIEF SUMMARY OF THE INVENTION

Solving the controllability issue is particularly difficult in light of the need to essentially inactivate the turbine of the TLR system during some engine operating conditions (e.g., wide-open throttle or WOT), while activating it for other conditions. This requires some type of valving system for selectively routing the intake air to the turbine before it is delivered to the intake manifold for some operating conditions, and for causing the air to bypass the turbine and proceed directly to the intake manifold at other operating conditions. To further complicate matters, during still other operating conditions it would be desirable to have one portion of the total air flow pass through the turbine while the remainder bypasses the turbine. Thus, controllability is not a trivial issue.

One possible approach to controllability is to provide a pair of valves in parallel, one regulating turbine air flow and the other regulating bypass air flow. Another approach is to provide a pair of valve in series, one controlling how the air flow is split between the turbine and the bypass passage, and the other controlling the total air flow. The drawbacks to the 2-valve approaches are high complexity and cost, and difficulty in coordinating the two valves so as to provide the desired throttling versus accelerator pedal position characteristic.

The present disclosure describes a butterfly bypass valve that is able to provide the functionality that the above-noted 2-valve systems provide, but is able to do so in a more-easily controllable fashion. The disclosed valve is also less-complex and smaller (and hence easier to package in the engine compartment) than 2-valve systems, and is expected to be more-reliable and less-costly than 2-valve systems.

In one embodiment, a butterfly bypass valve according to the present disclosure comprises a housing defining a bypass (or main) flow passage therethrough, and a throttle plate disposed in the bypass flow passage, the throttle plate being pivotable about a pivot axis oriented transverse to a flow direction through the bypass flow passage. An outer peripheral edge of the throttle plate is in substantially sealing engagement with a sealing portion of an inner surface of the housing when the throttle plate is in a closed position such that the throttle plate substantially restricts fluid flow through the bypass flow passage. The throttle plate is pivotable to an open position in which portions of the edge of the throttle plate are spaced from the inner surface to allow fluid flow through the bypass flow passage.

A port is defined through the housing for allowing a portion of fluid passing through the bypass flow passage to be removed through the port. The edge of the throttle plate restricts fluid flow into the port when the throttle plate is in the closed position. The port is uncovered to allow fluid flow into the port when the throttle plate is pivoted to the open position.

The sealing portion of the inner surface of the housing in substantially sealing engagement with the edge of the throttle plate is configured to allow a predetermined amount of pivoting of the throttle plate toward the open position while maintaining the edge of the throttle plate in substantially sealing engagement with the sealing portion so as to restrict fluid flow through the bypass flow passage. The port is located with respect to the sealing portion such that as the throttle plate is pivoted from the closed position toward the open position, the throttle plate begins to progressively uncover a first part of the port to allow fluid flow therethrough while the edge of the throttle plate is still in substantially sealing engagement with the sealing portion restricting fluid flow through the bypass flow passage.

In a preferred embodiment, the entire port is within the sealing portion.

Thus, the throttle plate regulates both the flow rate through the bypass flow passage and the flow rate through the port, and hence regulates the total flow rate through the valve. Flow through the port begins to occur while the bypass flow passage is still closed. In a preferred embodiment, the port is located with respect to the sealing portion such that the throttle plate begins to allow flow through the bypass flow passage before the port is fully uncovered by the throttle plate.

The valve is useful in various applications, and particularly is useful in a throttle loss recovery system for an internal combustion engine, comprising a turbine connected to an electrical generator. The valve is disposed in parallel with the turbine of the TLR system, such that by regulating the position of the valve's throttle plate the total air flow destined for the engine can be split in various ways between the turbine and the bypass flow passage of the valve. The port of the valve is connected to the turbine inlet. Thus, as the throttle plate begins to move from the closed position toward the open position, the port begins to open to allow flow through the turbine. The flow rate through the turbine is regulated by controlling the throttle plate position, and the turbine acts as a throttle to expand the air. The generator is driven to generate electrical power, thus recovering some of the energy that would otherwise have been lost in the throttling process.

As the throttle plate is moved further toward the open position, the port is further opened to increase the available flow area for the turbine air flow, and the bypass flow passage begins to open as the edge of the throttle plate departs from the sealing portion of the housing and portions of the edge of the throttle plate become spaced from the inner surface of the housing. As noted, preferably the bypass flow passage begins to open before the port is fully opened. This arrangement has been found to provide a total flow rate versus throttle plate position characteristic that closely mimics that of a conventional throttle. Thus, the butterfly bypass valve can be controlled in a fashion similar to that of a conventional throttle.

The sealing portion of the housing can be configured in various ways. For a throttle plate that is circular, the sealing portion can be a spherical surface (i.e., a contour corresponding to the edge of the throttle plate sweeping along an arc as the plate is pivoted). It will be recognized that a non-circular throttle plate could be used, and in that case the sealing portion would have a shape swept by the non-circular edge of the throttle plate.

In one embodiment, the first part of the port (i.e., the part first uncovered as the throttle plate opens) widens in a direction of movement of the edge of the throttle plate. The first part can have a "pointed" shape, for example. This results in the port flow area gradually increasing as the throttle plate angle increases, which improves controllability of the valve.

The first part of the port can transition into a second part of the port having a generally constant width in the direction of movement of the edge of the throttle plate. The second part of the port can transition into a third and final part of the port that narrows in the direction of movement of the edge of the throttle plate. Configuring the port in this manner provides smooth transitions from closed to partially open (governed by the widening first part of the port), from partially open to further-open (governed by the generally constant-width second part), and from further-open to fully open (governed by the narrowing third part).

The housing can further include a return passage spaced from the port and extending into the bypass flow passage, through which fluid removed from the bypass flow passage via the port is returned to the bypass flow passage. Thus, when the bypass valve is incorporated into a TLR system, the air that has passed from the bypass flow passage, out the port, and through the turbine, is returned to the bypass flow passage via the return passage. This returned air joins with any air that bypasses the turbine (i.e., when the throttle plate is not closed), and the combined air stream is supplied to the engine's intake manifold.

BRIEF DESCRIPTION OF THE SEVERAL VIEWS OF THE DRAWING(S)

Having thus described the embodiments in general terms, reference will now be made to the accompanying drawings, which are not necessarily drawn to scale, and wherein:

Figure 10:
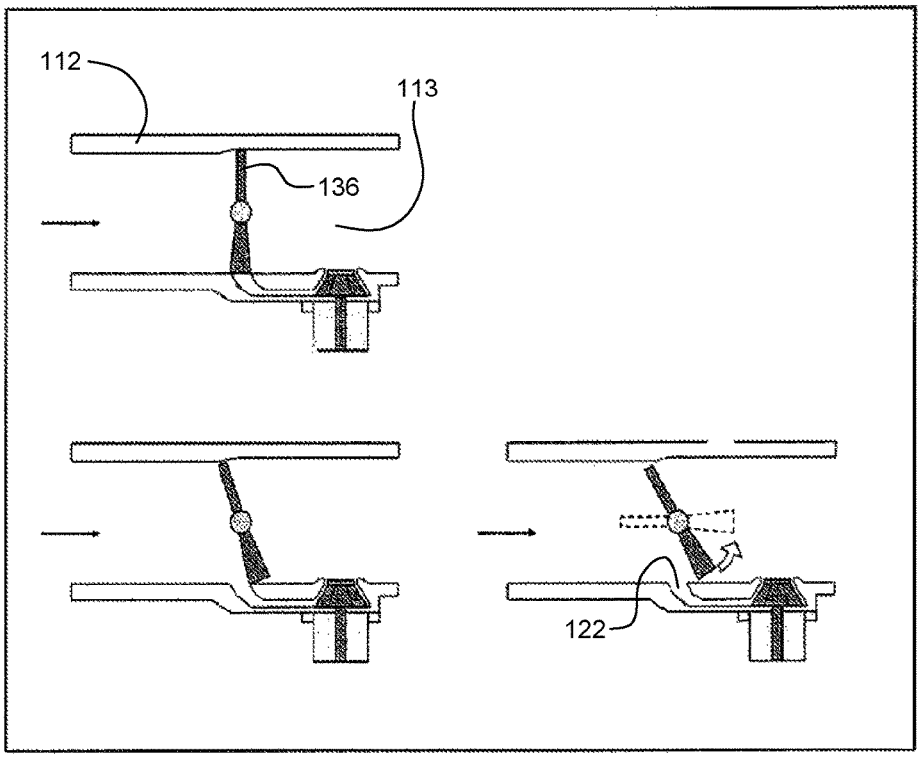
Figure 11:
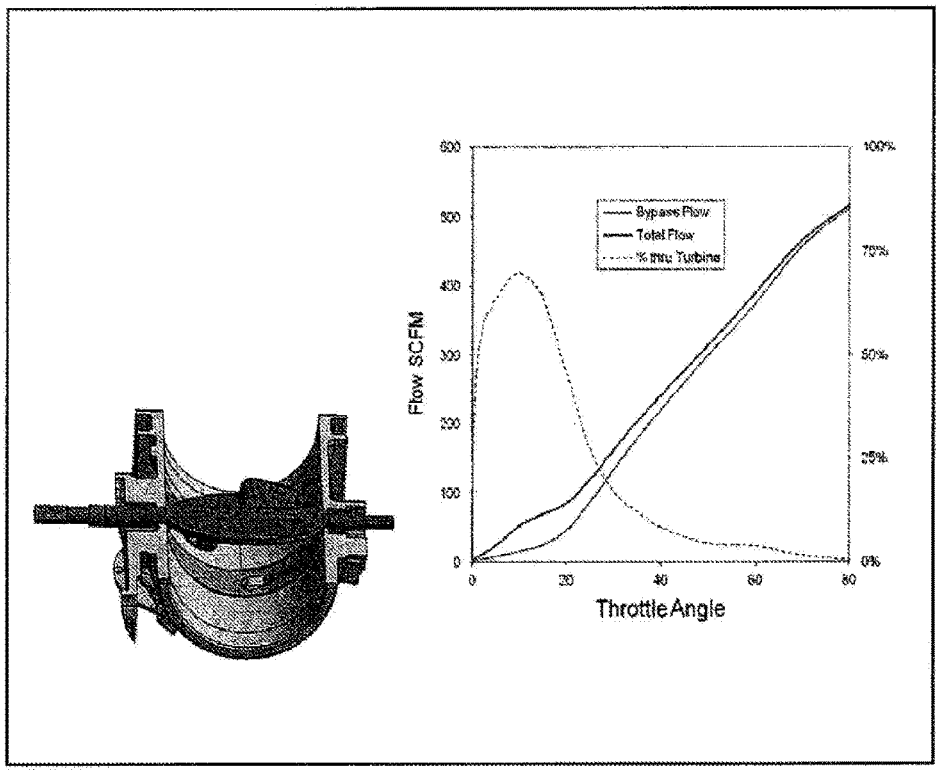
Figure 12:
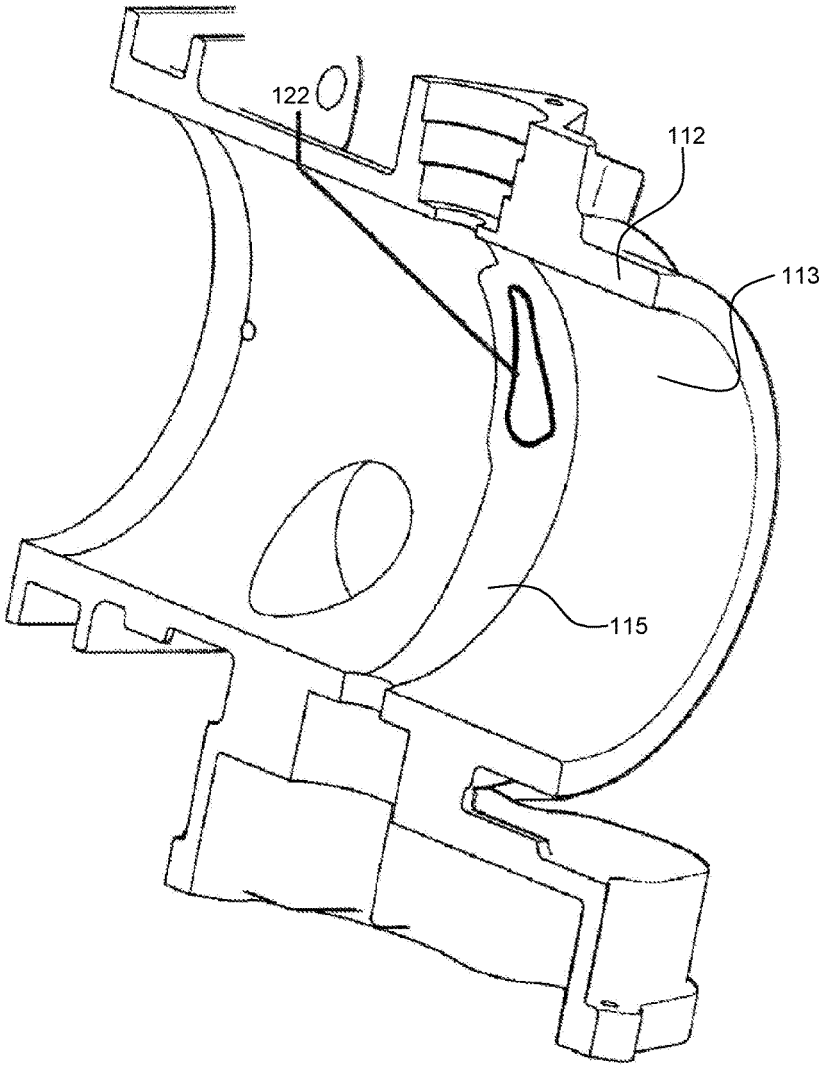
Figure 13:
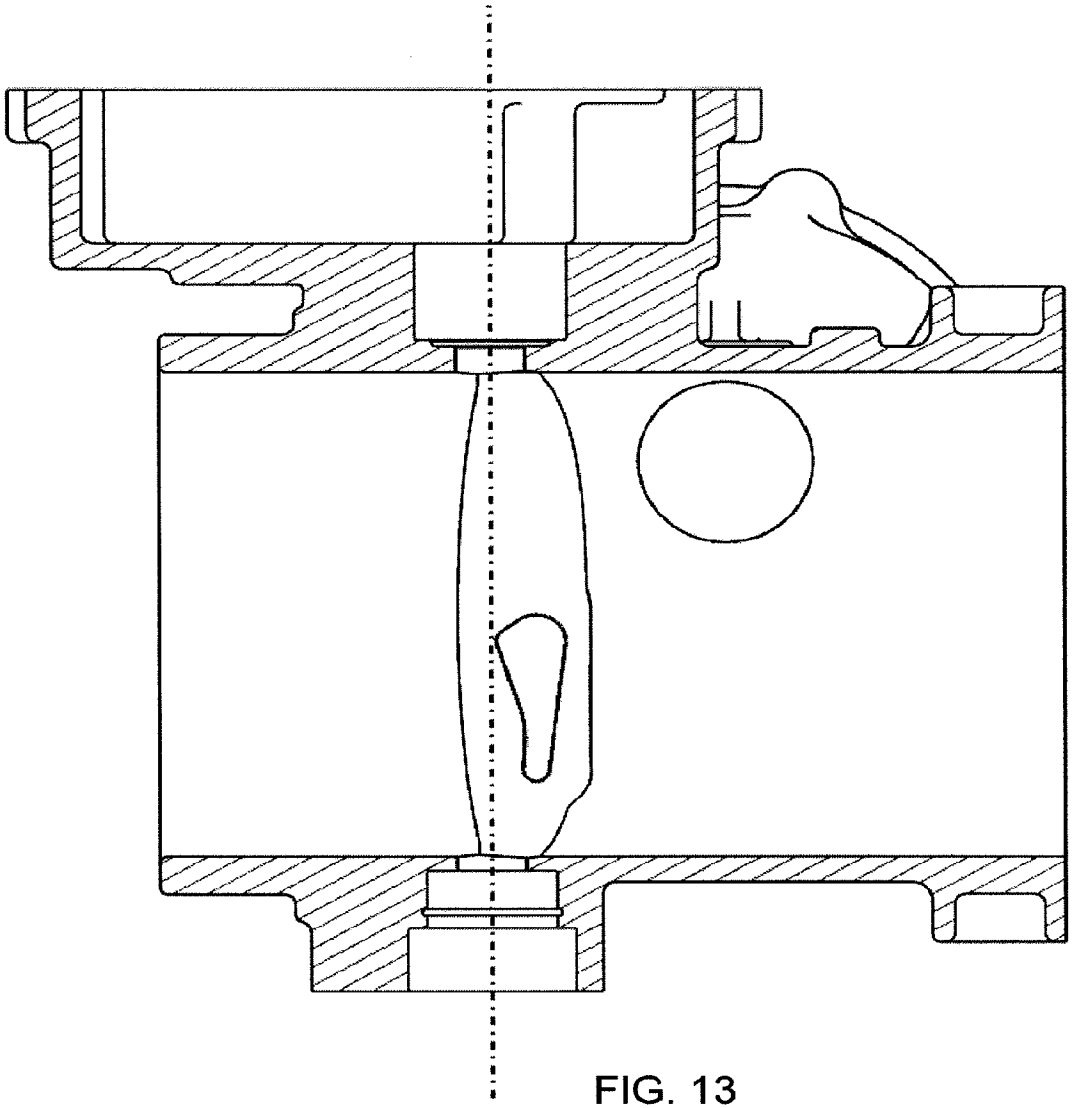
Figure 14:
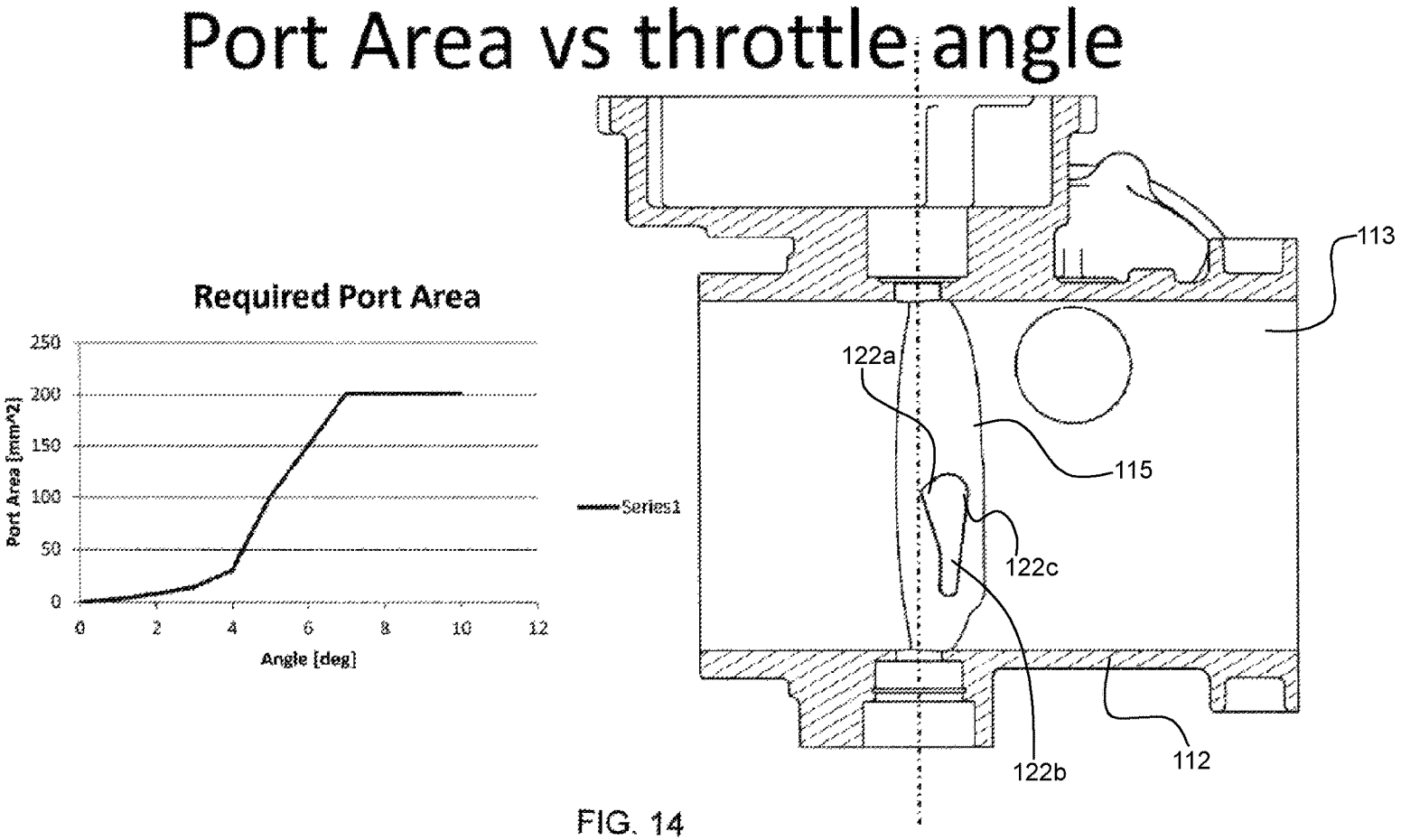
Figure 15:
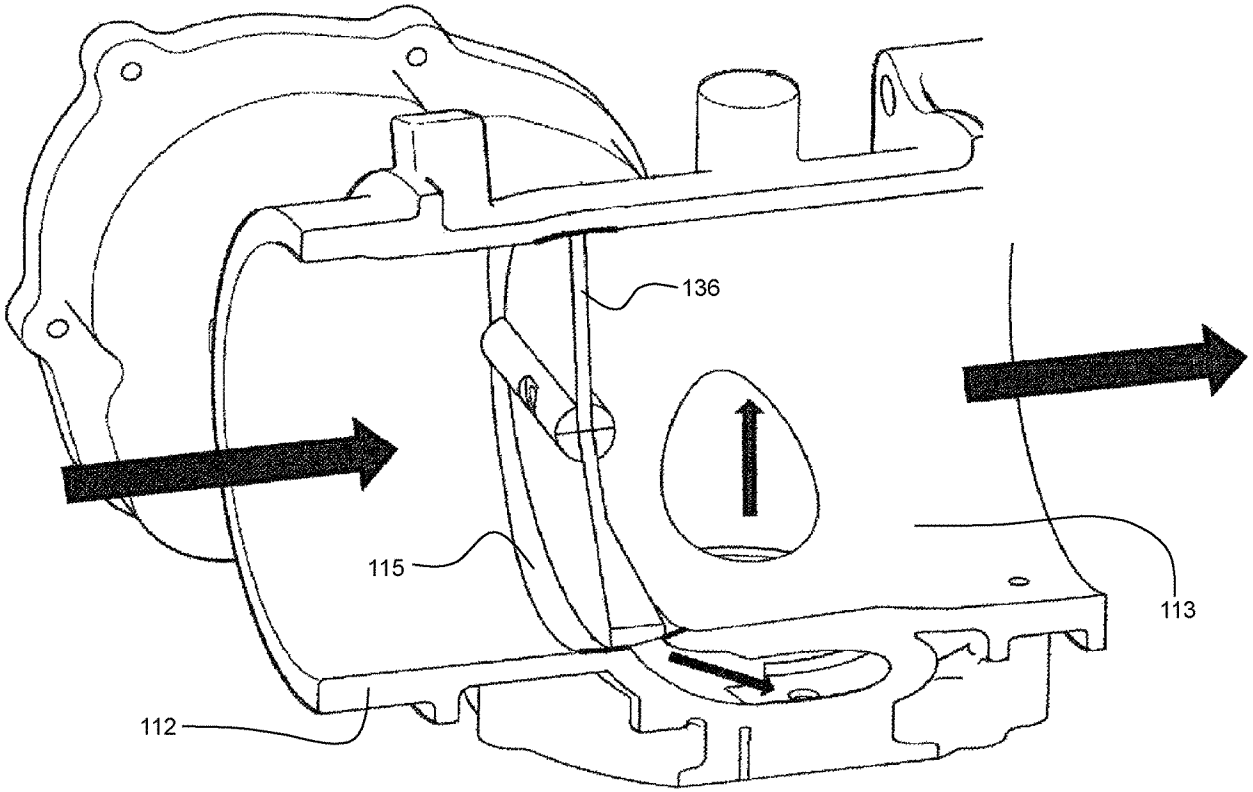
Figure 16:
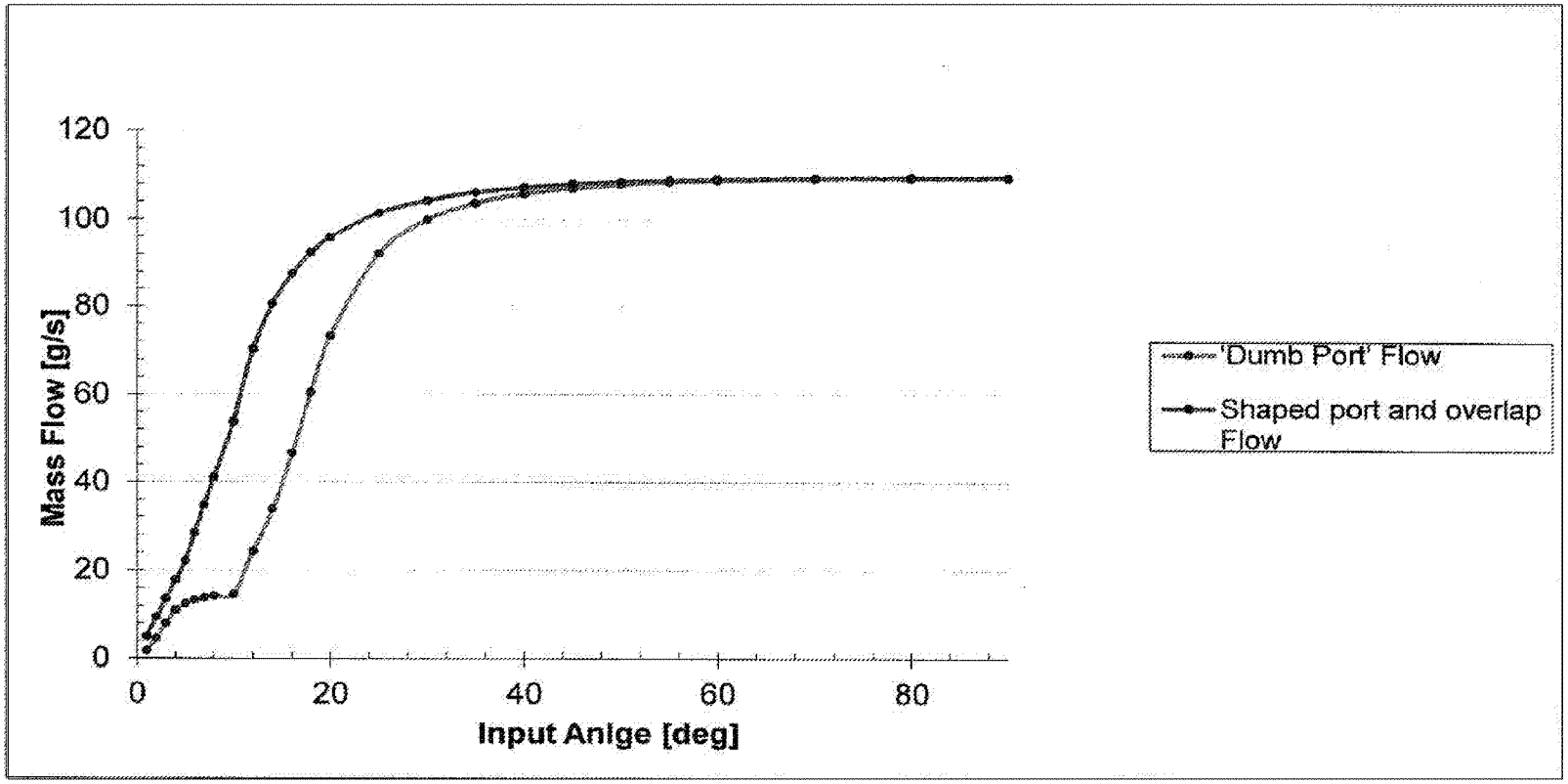
Figure 17:
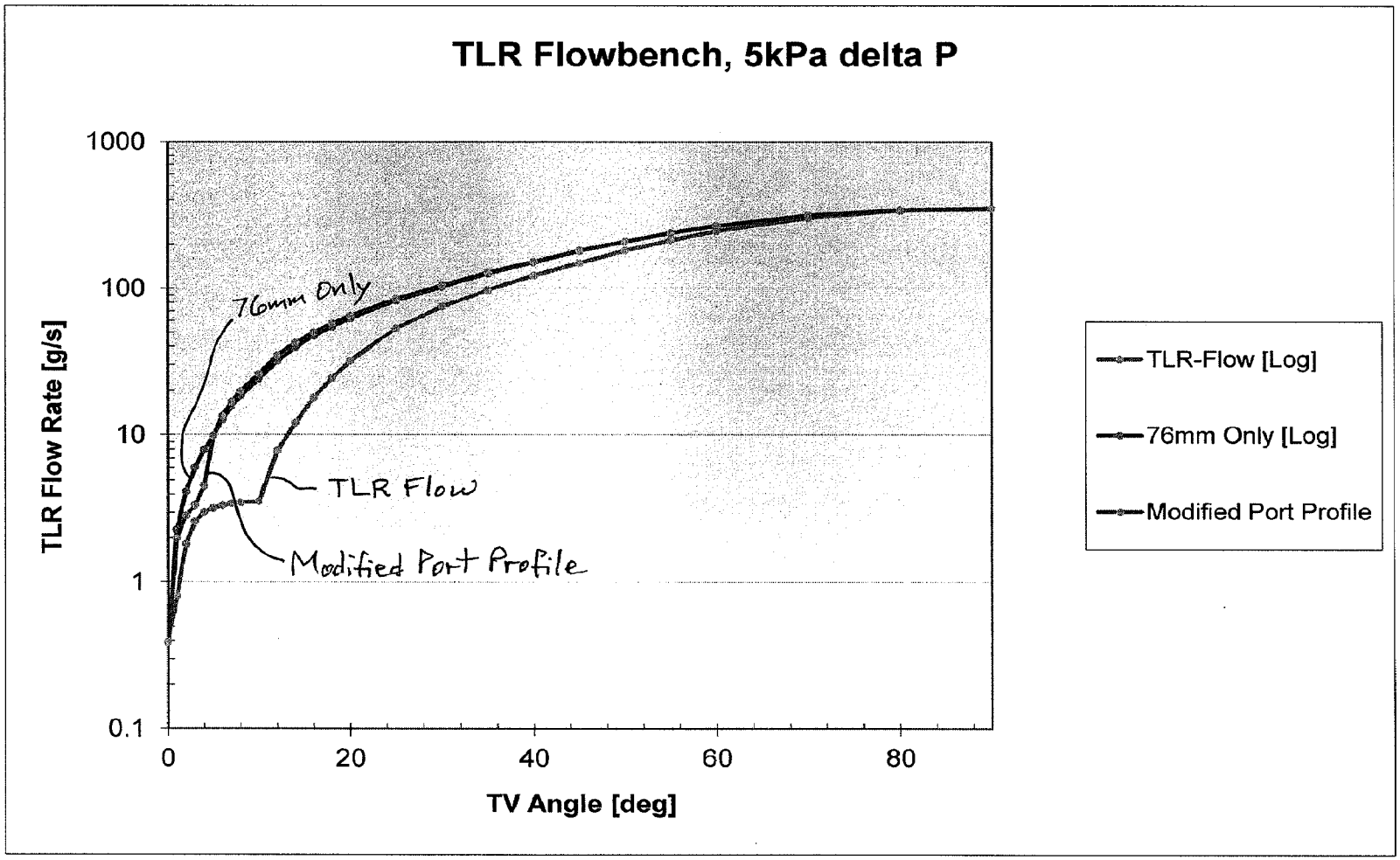
Figure 18:
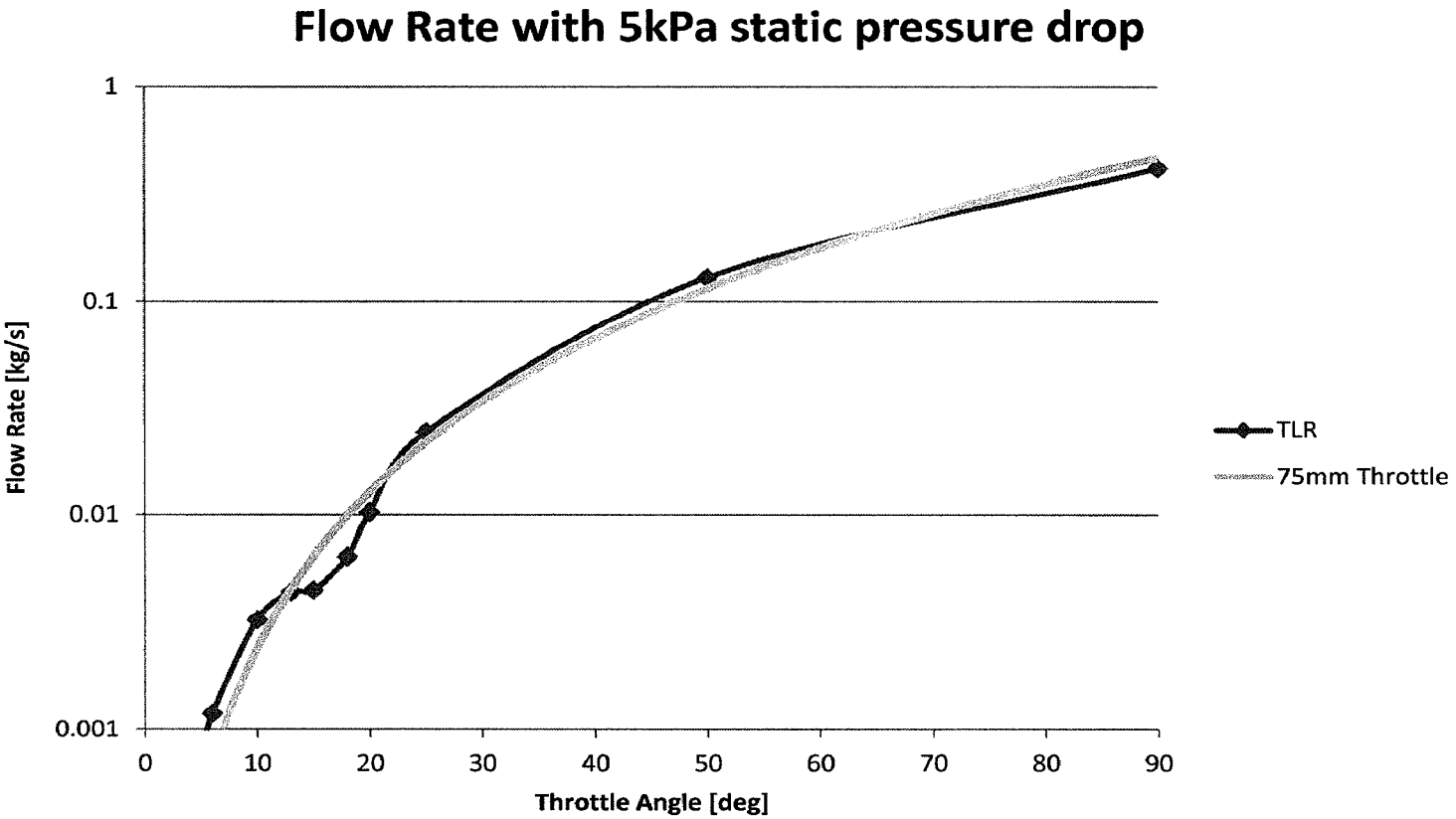

FIG. 10 diagrammatically shows the butterfly plate in idle, low-power/cruise, and high-power (bypass) modes;

FIG. 11 illustrates how bore-contouring and port-shaping enable tuning of the flow characteristic of the valve;

FIG. 12 shows how the bypass port is shaped to open progressively as the throttle plate is moved;

FIG. 13 is a sectioned side view of the valve housing, showing the port shaping;

FIG. 14 depicts port area versus throttle angle in one embodiment;

FIG. 15 shows how a spherical surface (for a round throttle plate) begins to allow flow directly through the valve after 13 degrees of plate rotation, which is a few degrees before the bypass port is completely open, in accordance with one embodiment;

FIG. 16 illustrates a performance comparison between a typical elliptical port configuration and a port configuration in accordance with an embodiment of the invention, in terms of mass flow rate versus throttle plate angle; and FIGS. 17 and 18 show results of a flow rate bench test.

DETAILED DESCRIPTION OF THE DRAWINGS

Apparatuses and methods for controlling flow of a fluid now will be described more fully hereinafter with reference to the accompanying drawings in which some but not all embodiments are shown. Indeed, the present development may be embodied in many different forms and should not be construed as limited to the embodiments set forth herein; rather, these embodiments are provided so that this disclosure will satisfy applicable legal requirements. Like numbers refer to like elements throughout.

Figure 1:
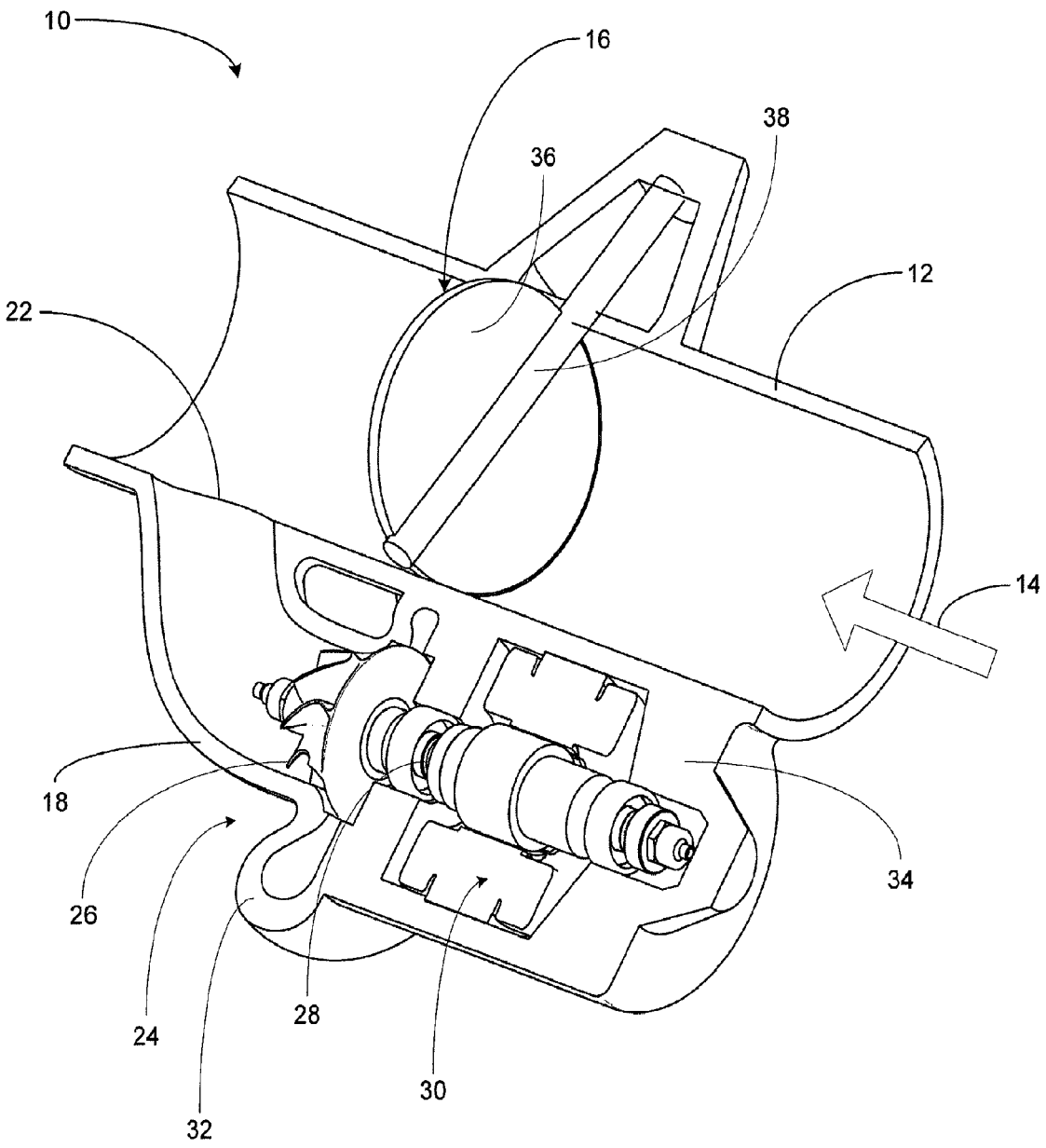
FIG. 1 illustrates a cross-sectional view of an embodiment of a flow-control assembly in a first position wherein a flow-control valve substantially blocks flow of a fluid through a fluid conduit and a fluid expansion conduit.

Referring to FIG. 1, a cross-sectional view through an embodiment of a flow-control assembly 10 is illustrated. The flow control assembly 10 may comprise a fluid conduit 12 which is configured to receive flow 14 of a fluid. In an example embodiment, the fluid may comprise air which is supplied to an engine, as will be described below with respect to a system embodiment. A flow-control valve 16 is positioned in the fluid conduit 12. The flow-control assembly 10 further includes a fluid expansion conduit 18. The fluid expansion conduit 18 comprises an inlet 20 (see FIGS. 2-4) which may be defined at least in part by the fluid conduit 12 and configured to selectively receive flow 14 of the fluid from the fluid conduit. Further, an outlet 22 of the fluid expansion conduit 18 is in fluid communication with the fluid conduit 12 downstream of the flow-control valve 16. Downstream, as used herein, refers to placement which is generally past the referenced item in terms of the normal flow of the fluid during operation of the flow-control assembly 10. Conversely, upstream, as used herein, may refer to placement which is generally before the referenced item in terms of the normal flow of the fluid during operation of the flow-control assembly 10.

The flow-control assembly 10 further comprises a rotating fluid expander 24 in the fluid expansion conduit 18 which is configured to expand the fluid when it is supplied thereto and thereby rotate. Thus, it should be understood that the fluid expansion conduit 18 does not necessarily expand the fluid itself, but rather the fluid expansion conduit is named as such because it contains the rotating fluid expander 24, which expands the fluid. The rotating fluid expander 24 may comprise a turbine 26 mounted on a shaft 28 which allows the rotating fluid expander to rotate. The shaft 28, in turn, may be coupled to an electrical generator 30 which is configured to produce electrical energy when the rotating fluid expander 24 rotates. However, many alternative devices may be coupled to the rotating fluid expander 24. For instance, in other embodiments the shaft 28 may be coupled to a compressor in order to create a pressurized air flow, or the shaft may be coupled to a pulley which then drives an accessory item. Various other alternative devices may be coupled to the rotating fluid expander 24 as would be understood by one having ordinary skill in the art.

Further, the fluid expansion conduit 18 may comprise a volute 32 which substantially surrounds the rotating fluid expander 24 and supplies flow of the fluid thereto. Additionally, as illustrated, in some embodiments the fluid conduit 12 and the fluid expansion conduit 18 may be defined by an integral housing 34. Thus, in some embodiments the rotating fluid expander 24 and the electrical generator 30 may also be retained within the integral housing 34. Accordingly, the entire flow-control assembly 10 may comprise a relatively compact form.

Further, in some embodiments the fluid expansion conduit 18 may comprise alternative or additional features configured to provide the flow 14 of the fluid to the rotating fluid expander 24. In this regard, in some embodiments the flow-control assembly 10 may comprise vanes and/or a nozzle instead of, or in addition to the volute 32 described above. In some embodiments the vanes may comprise variable vanes and/or the nozzle may comprise a variable nozzle and thus the flow 14 of the fluid may be controlled by adjusting the variable vanes and/or the variable nozzle, thereby adjusting the flow of the fluid to the rotating fluid expander 24. In addition to controlling flow 14 of the fluid through the fluid expansion conduit 18, variable mechanisms may allow for more efficient extraction of power with the rotating fluid expander 24. Accordingly, the geometry of the rotating fluid expander 24 and the fluid expansion conduit 18 may differ in various embodiments.

The flow-control valve 16 is configurable between multiple positions. For instance, in some embodiments the flow-control valve 16 may comprise a butterfly valve such as when the flow-control valve comprises a throttle plate 36. Further, the flow-control valve 16 may comprise a valve adjustment mechanism such as an electric motor or throttle cable which is configured to control the flow-control valve by adjusting the position of the throttle plate 36. Specifically, the flow-control valve 16 may be controlled by rotating a shaft 38 to which the throttle plate 36 is coupled about its longitudinal axis. In some embodiments the flow-control assembly 10 may further comprise a valve position sensor which is configured to detect the position of the flow-control valve. For example, the throttle position sensor may be connected to the shaft 38 in some embodiments. Thus, the throttle position sensor may be used to provide feedback as to the position of the throttle plate 36 such that the position of the flow-control valve 16 may be adjusted to the desired position.

FIG. 1 illustrates the flow-control assembly 10 when the flow-control valve 16 is configured to a first position wherein the flow-control valve substantially blocks flow 14 of the fluid through the fluid conduit 12 and the fluid expansion conduit 18. As will be described below, in some embodiments the flow-control assembly 10 may be used to throttle a flow of air to an engine. Accordingly, the flow-control valve 16 may be configured in some embodiments to substantially block flow 14 of the fluid while allowing a small flow of the fluid through the flow-control assembly 10 in order to allow the engine to idle.

Figure 2:
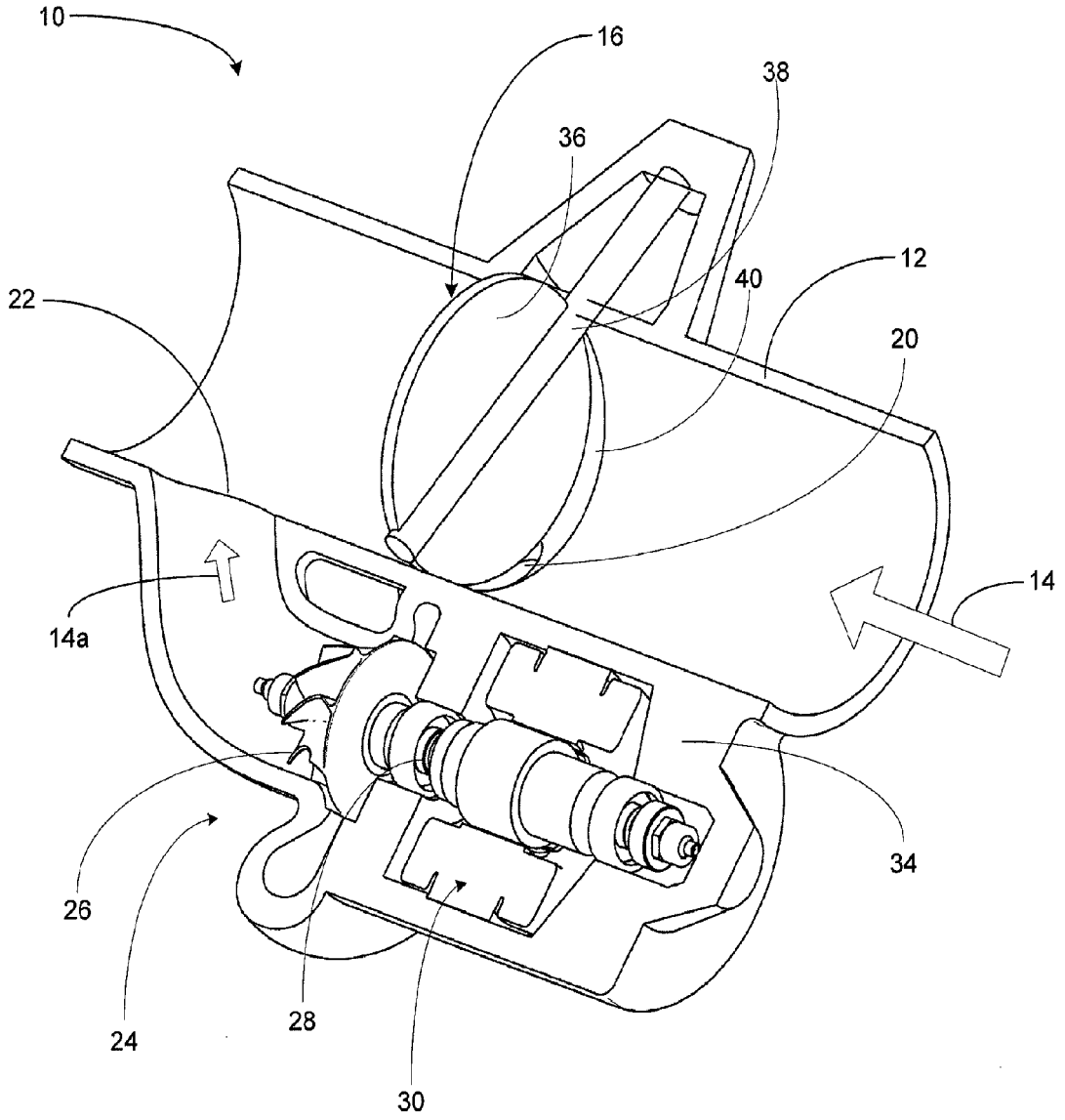
FIG. 2 illustrates a cross-sectional view of the embodiment of the flow-control assembly of FIG. 1 in a second position wherein a flow-control valve substantially blocks flow of a fluid through the fluid conduit and at least partially unblocks an inlet of the fluid expansion conduit to thereby allow a relatively small flow of the fluid through the fluid expansion conduit.
Figure 3:
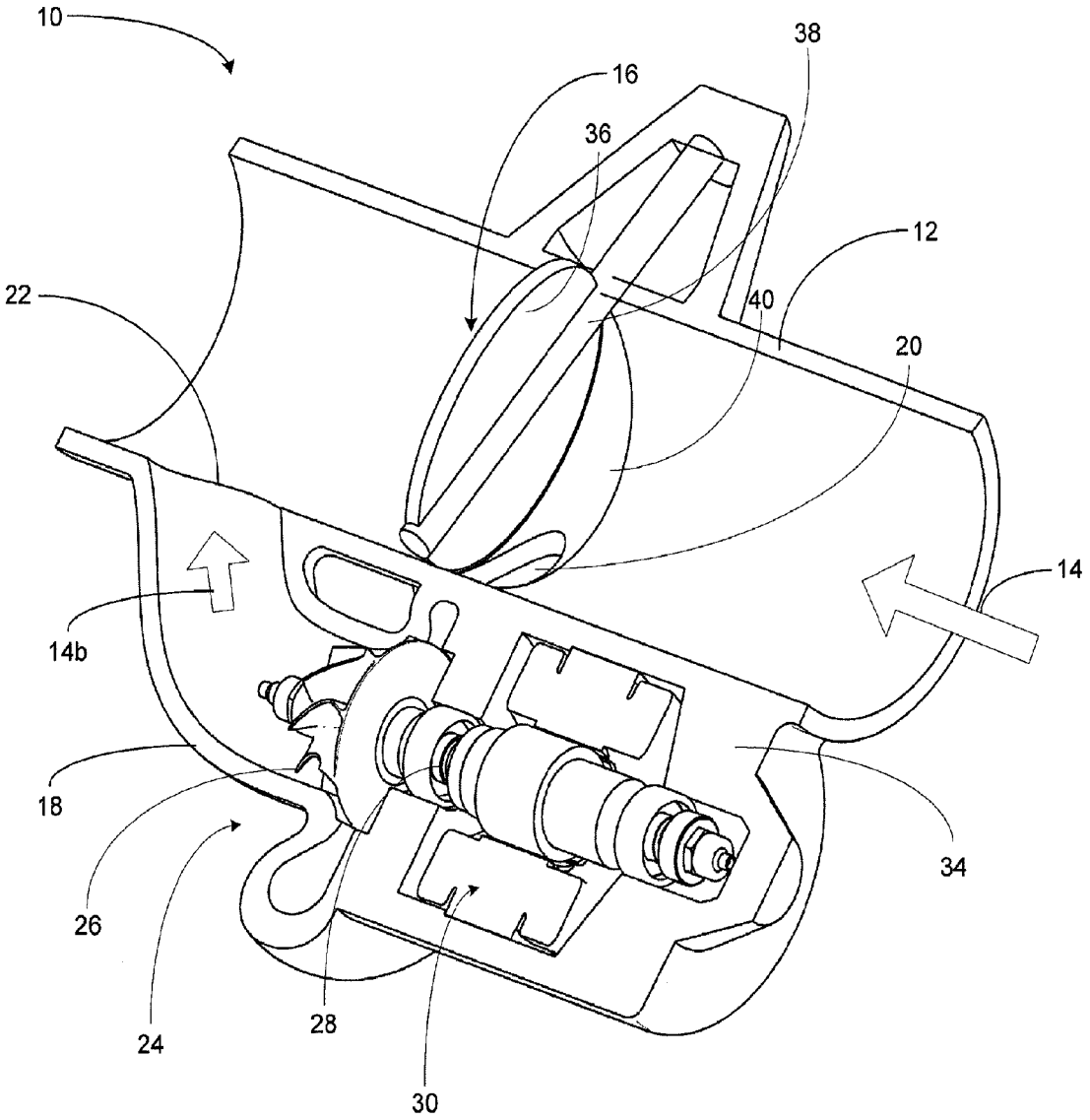
FIG. 3 illustrates a cross-sectional view of the embodiment of the flow-control assembly of FIG. 1 in the second position wherein the flow-control valve substantially blocks flow of a fluid through the fluid conduit and at least partially unblocks the inlet of the fluid expansion conduit to thereby allow a relatively larger flow of the fluid through the fluid expansion conduit.

FIGS. 2 and 3 illustrates the flow-control assembly 10 when the flow-control valve 16 is configured to a second position wherein the flow-control valve substantially blocks flow 14 of the fluid through the fluid conduit 12 and at least partially unblocks the inlet 20 of the fluid expansion conduit 18 to thereby allow flow 14*a*, 14*b* of the fluid through the fluid expansion conduit. In FIG. 2 the flow-control valve 16 has only slightly transitioned from the first position to the second position by rotating the throttle plate 36 clockwise about the shaft 38, and hence a relatively small flow 14*a* of the fluid is allowed through the fluid expansion conduit 18. However, as illustrated, the flow-control assembly 10 substantially blocks flow of the fluid past the flow-control valve 16 through the fluid conduit 12. In the embodiment illustrated herein, this is accomplished by creating a tight fit between the throttle plate 36 and the fluid conduit 12 in which the flow-control valve 16 is positioned. In particular, in the illustrated embodiment the fluid conduit 12 includes a sealing wall 40 which the throttle plate 36 substantially engages when the flow-control valve 16 is in the first position. In order to accommodate rotation of the throttle plate 36 about the shaft 38, the sealing wall 40 defines a curved profile of substantially the same radius as the throttle plate whereby the throttle plate thus maintains a tight fit with the sealing wall as it rotates to the second position.

However, as illustrated, the inlet 20 to the fluid expansion conduit 18 is also defined at least in part by the fluid conduit 12. Specifically, the inlet 20 comprises a hole in the sealing wall 40 at which the throttle plate 36 is out of contact with the fluid conduit 12 when the flow-control valve 16 is in the second position. Thus, the relatively small flow 14*a* of the fluid is allowed through the inlet 20 to the fluid expansion conduit 18. After traveling through the inlet 20, the fluid may enter the volute 32 which thereby feeds the fluid to the turbine 26 of the rotating fluid expander 24. Thus, the fluid is expanded by the turbine 26, causing the turbine to rotate the shaft 28 which enables the electrical generator 30 to thereby generate electrical current. As the flow of the fluid exits the turbine 26, it is directed to the outlet 22 of the fluid expansion conduit 18. As illustrated, in some embodiments the outlet 22 of the fluid expansion conduit connects to the fluid conduit 12 downstream of the flow-control valve 16 such that the outlet is in fluid communication with the fluid conduit downstream of the flow-control valve. Thus, the fluid expansion conduit 18 acts as a bypass around the flow-control valve 16 when the flow-control valve is in the second position.

Accordingly, as described above, the rotating fluid expander 24 may create electricity using the electrical generator 30 when the flow-control valve 16 is in the second position. Further, the flow-control valve 16 may be adjusted to allow for varying degrees of flow of the fluid through the flow-control assembly 10 when the flow-control valve is in the second position. For instance, whereas FIG. 2 illustrates the flow-control valve 16 when it has just entered the second position and accordingly only a relatively small portion of the inlet 20 of the fluid expansion conduit 18 is unblocked, FIG. 3 illustrates the flow-control valve 16 as it has opened further within the second position. Specifically, FIG. 3 illustrates the flow-control valve 16 with the throttle plate 36 rotated within the second position to a point at which the inlet 20 to the fluid expansion conduit 18 is substantially fully unblocked. Accordingly, flow of the fluid through the flow-control assembly 10 may be adjusted to the desired level by adjusting the flow-control valve 16 within the second position. Thus, for example, the arrangement of the flow-control valve 16 in FIG. 3 may allow for a relatively large flow 14*b* of the fluid through the fluid expansion conduit 18 as compared to the relatively small flow 14*a* of the fluid allowed by the configuration illustrated in FIG. 2. Further, the second position of the flow-control valve 16, as illustrated in FIGS. 2 and 3 directs substantially all of the flow 14 of the fluid through the fluid expansion conduit 18. Accordingly, the desired amount of flow of the fluid may be achieved while at the same time using the rotating fluid expander 24 to generate electricity by way of the electrical generator 30.

Figure 4:
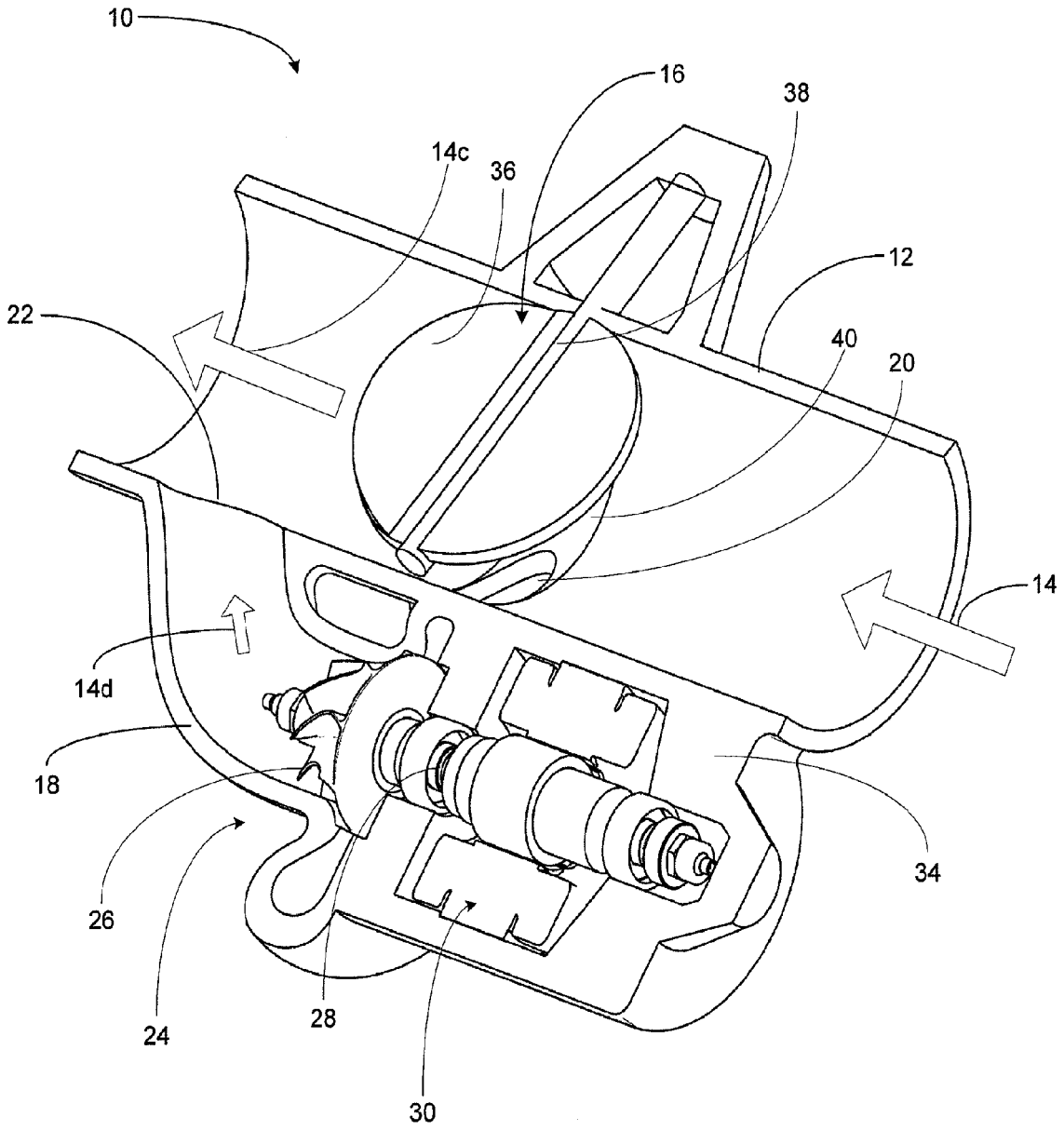
FIG. 4 illustrates a cross-sectional view of the embodiment of the flow-control assembly of FIG. 1 in a third position wherein the flow-control valve at least partially unblocks the fluid conduit to thereby allow flow of the fluid through the fluid conduit without necessary passing through the fluid expansion conduit.

However, in some instances additional flow of the fluid through the flow-control assembly 10 may be desirable. Accordingly, as illustrated in FIG. 4, the flow-control valve 16 may be configurable to a third position wherein the flow-control valve at least partially unblocks the fluid conduit 12 to thereby allow flow 14 of the fluid through the fluid conduit without necessarily passing through the fluid expansion conduit 18. In the third position the throttle plate 36 is rotated, clockwise as illustrated, past the inlet 20 to the fluid expansion conduit 18 and out of contact with the sealing wall 40. This allows a direct flow 14*c* of the fluid to pass through the flow-control valve 16 via the fluid conduit 12 without traveling through the fluid expansion conduit 18. However, in some embodiments a bypass flow 14*d* of the fluid may still travel through the fluid expansion conduit 18 in some instances due to the inlet 20 to the fluid expansion conduit remaining unblocked. Thus, by rotating the throttle plate 36 such that it is substantially parallel with the flow 14 of the fluid, the flow-control valve 16 may allow a maximum flow through the flow-control assembly 10 when the flow-control valve is in the third position.

Figure 5:
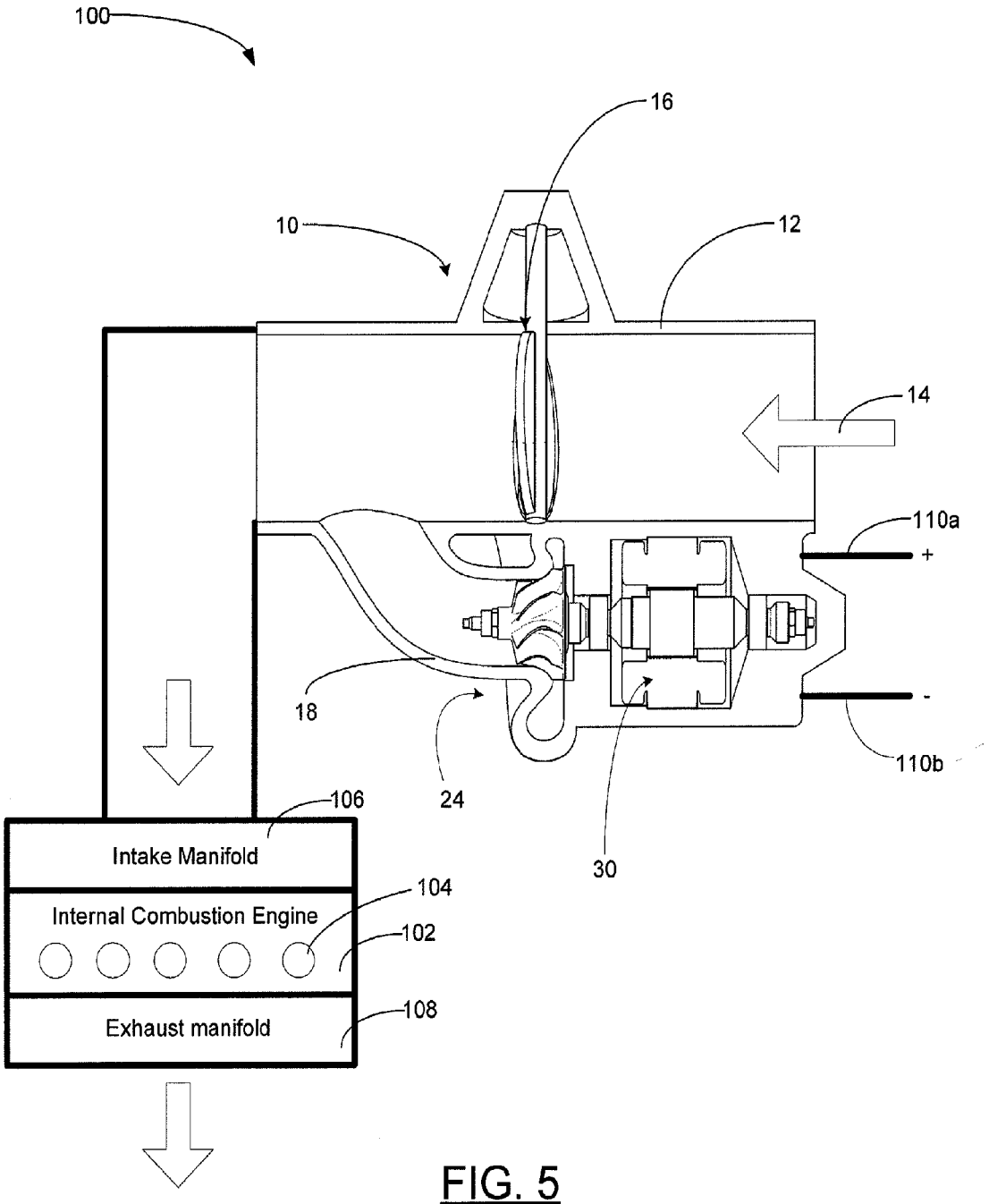
FIG. 5 illustrates a schematic view of a system for controlling flow of a fluid to an internal combustion engine comprising the flow-control assembly of FIG. 1

As schematically illustrated in FIG. 5, a system 100 for controlling flow of a fluid is also provided. The system 100 may comprise the flow-control assembly 10 including the fluid conduit 12 which is configured to receive flow 14 of a fluid, such as from an air intake which may include an air filter in some embodiments. Further, the flow-control valve 16 is in the fluid conduit. Additionally, the fluid expansion conduit 18 comprises the inlet 20 (see FIGS. 2-4), which is defined at least in part by the fluid conduit 12 and configured to selectively receive flow of the fluid from the fluid conduit. Further, the outlet 22 of the fluid expansion conduit 18 is in fluid communication with the fluid conduit 12 downstream of the flow-control valve 16. The flow-control assembly 10 also includes the rotating fluid expander 24 in the fluid expansion conduit 18, wherein the rotating fluid expander is configured to expand the fluid and thereby rotate. As described above, the flow-control valve 16 may be configurable between multiple positions including the first position, as illustrated, wherein the flow-control valve substantially blocks flow 14 of the fluid through the fluid conduit 12 and the fluid expansion conduit 18.

In addition to the flow-control assembly 10, the system 100 further comprises an internal combustion engine 102 comprising one or more cylinders 104. Thus, the flow-control assembly 10 may be configured to direct flow 14 of the fluid to one or more of the cylinders 104 of the internal combustion engine 102. The system 100 may additionally comprise an intake manifold 106 configured to receive flow of the fluid from the flow-control assembly 10 and distribute flow of the fluid to one or more of the cylinders 104 of the internal combustion engine 102. Further, the system 100 may include an exhaust manifold 108 configured to receive flow of the fluid from one or more of the cylinders 104 of the internal combustion engine 102, before exhausting the flow to the surroundings.

As illustrated, in some embodiments the flow-control valve 16 is the only valve for controlling flow of the fluid into the intake manifold 106. Accordingly, the load of the internal combustion engine 102 may be controlled in a substantially simple manner. Further, by using just one valve, the flow-control assembly 10 may occupy a relatively small amount of space which may be important when the system 100 is employed in an automotive context. However, in addition to controlling the amount of fluid supplied to the engine, which is air in this embodiment, the flow-control assembly 10 may be able to generate electricity when all or a portion of the flow 14 of the fluid is directed through the fluid expansion conduit 18. In particular, when an electric generator 30 is coupled to the rotating fluid expander 24, two leads 110*a*, 110*b* may be connected, for example, to a battery to thereby charge the battery. Thus, some of the energy that would otherwise be wasted in throttling the flow 14 of the fluid may be recovered during partial throttle situations such as when the flow-control valve 16 is in the second position. However, when full throttle is desired, the flow-control valve 16 may open to the third position and thereby allow a substantially unimpeded flow through the fluid conduit 12, to thereby reduce any loses associated with using a rotating fluid expander 24 in the flow-control assembly 10.

Further, a method of controlling the flow of a fluid to an internal combustion engine 102 is also provided. The method may comprise selectively configuring a flow-control valve 16 between a first position wherein the flow-control valve substantially blocks flow of the fluid through a fluid conduit 12 and a fluid expansion conduct 18, and a second position wherein the flow-control valve substantially blocks flow of the fluid through the fluid conduit and at least partially unblocks the fluid expansion conduit to thereby allow flow of the fluid through the fluid expansion conduit. The method further comprises expanding the fluid in the fluid expansion conduit 18 when flow of the fluid is directed thereto to thereby rotate a rotating fluid expander 24, and supplying the expanded fluid to the internal combustion engine 102. In some embodiments the method may further comprise generating electricity by coupling the rotating fluid expander 24 to an electrical generator 30. Additionally, the method may include directing flow of the fluid through the fluid expansion conduit 18 back into the fluid conduit 12 downstream of the flow-control valve 16. The method may further comprise selectively configuring the flow-control valve 16 to a third position wherein the flow-control valve at least partially unblocks the fluid conduit 12 to thereby allow flow of the fluid through the fluid conduit without necessarily passing through the fluid expansion conduit 18, and supply fluid from the fluid conduit to the internal combustion engine 102. Accordingly, embodiments of methods for controlling the flow of a fluid to an internal combustion engine are also provided.

Although embodiments of the flow-control assembly have generally been described and shown as employing the flow-control valve to block and unblock the inlet of the fluid expansion conduit, in alternate embodiments the flow-control valve may block and unblock the outlet of the fluid expansion conduit. In this regard, embodiments wherein the flow-control valve selectively opens and closes the outlet of the fluid expansion conduit in varying degrees may function in substantially the same manner as embodiments in which the inlet of the fluid expansion conduit is selectively opened and closed by the flow-control valve. In particular, controlling opening and closing of an end of the fluid expansion conduit in the manner described above may provide substantially the same functionality, regardless of whether control of the inlet or the outlet of the fluid expansion conduit is employed.

Figure 6:
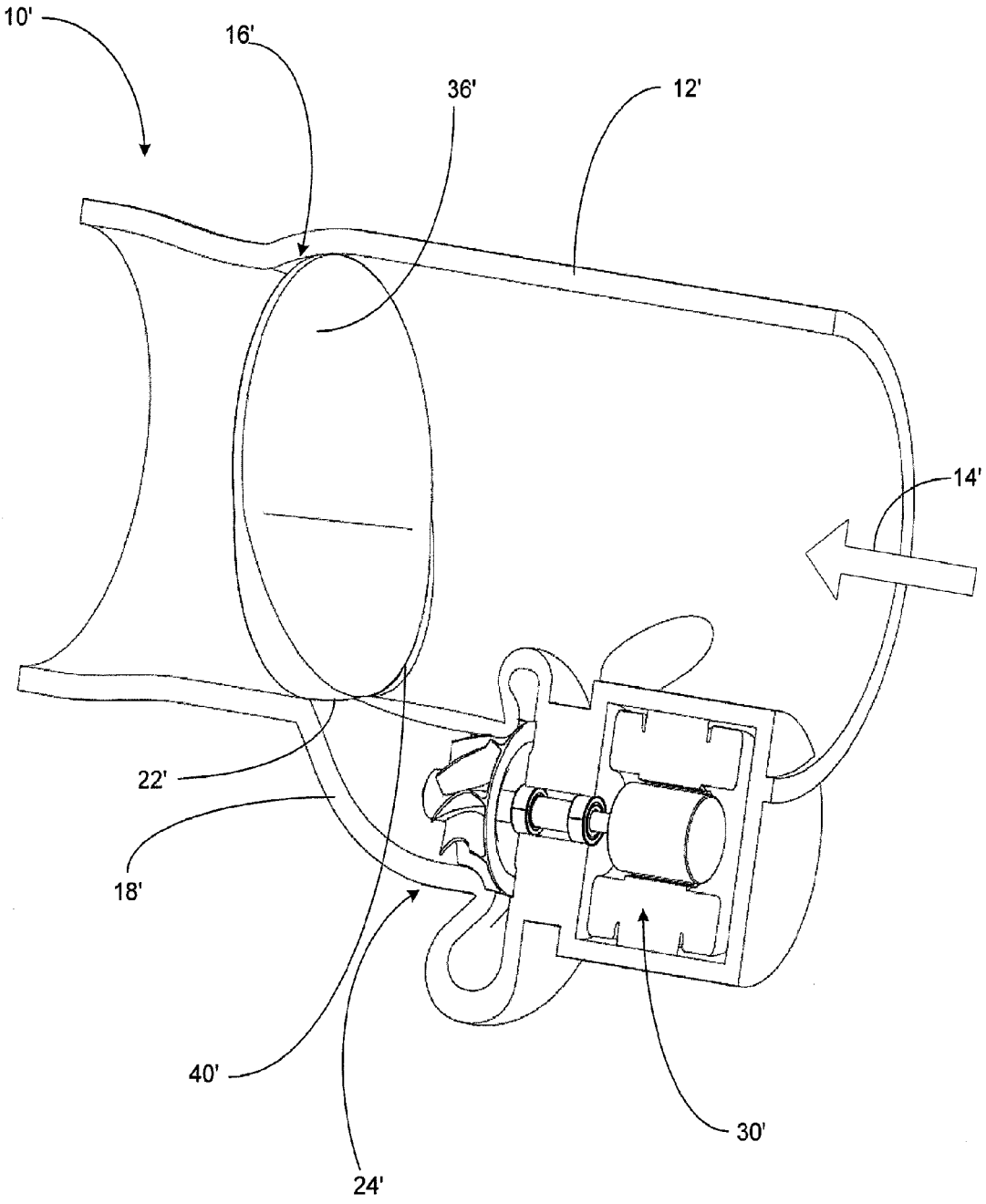
FIG. 6 illustrates a cross-sectional view of a second embodiment of a flow-control assembly in a first position wherein a flow-control valve substantially blocks flow of a fluid through a fluid conduit and a fluid expansion conduit.

However, by way of brief explanation, FIGS. 6-9 illustrate a second embodiment of the flow-control assembly 10' wherein the flow-control valve 16' is configurable between a plurality of positions which block or allow flow of the fluid through the fluid expansion conduit 18' and the fluid conduit 12'. In this regard, FIG. 6 illustrates a cross-sectional view of the flow control assembly 10' when the flow-control valve 16' is in a first position wherein the flow-control valve substantially blocks flow 14' of the fluid through the fluid conduit 12' and the and the fluid expansion conduit 18'. Flow 14' of the fluid through the fluid expansion conduit 18' is restricted by blocking the outlet 22' of the fluid expansion conduit 18'.

Figure 7:
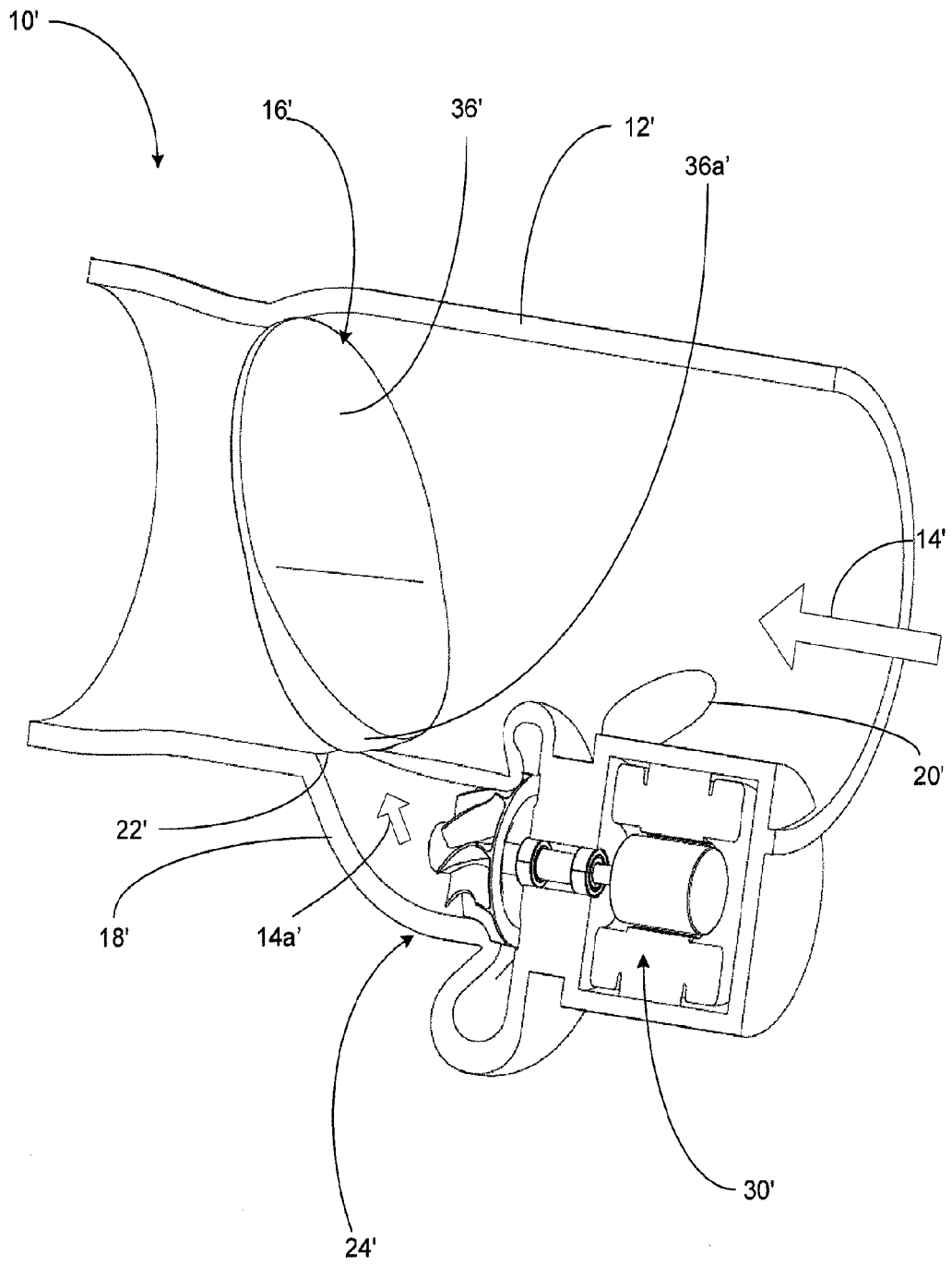
FIG. 7 illustrates a cross-sectional view of the second embodiment of the flow-control assembly of FIG. 6 in a second position wherein a flow-control valve substantially blocks flow of a fluid through the fluid conduit and at least partially unblocks an outlet of the fluid expansion conduit to thereby allow a relatively small flow of the fluid through the fluid expansion conduit.
Figure 8:
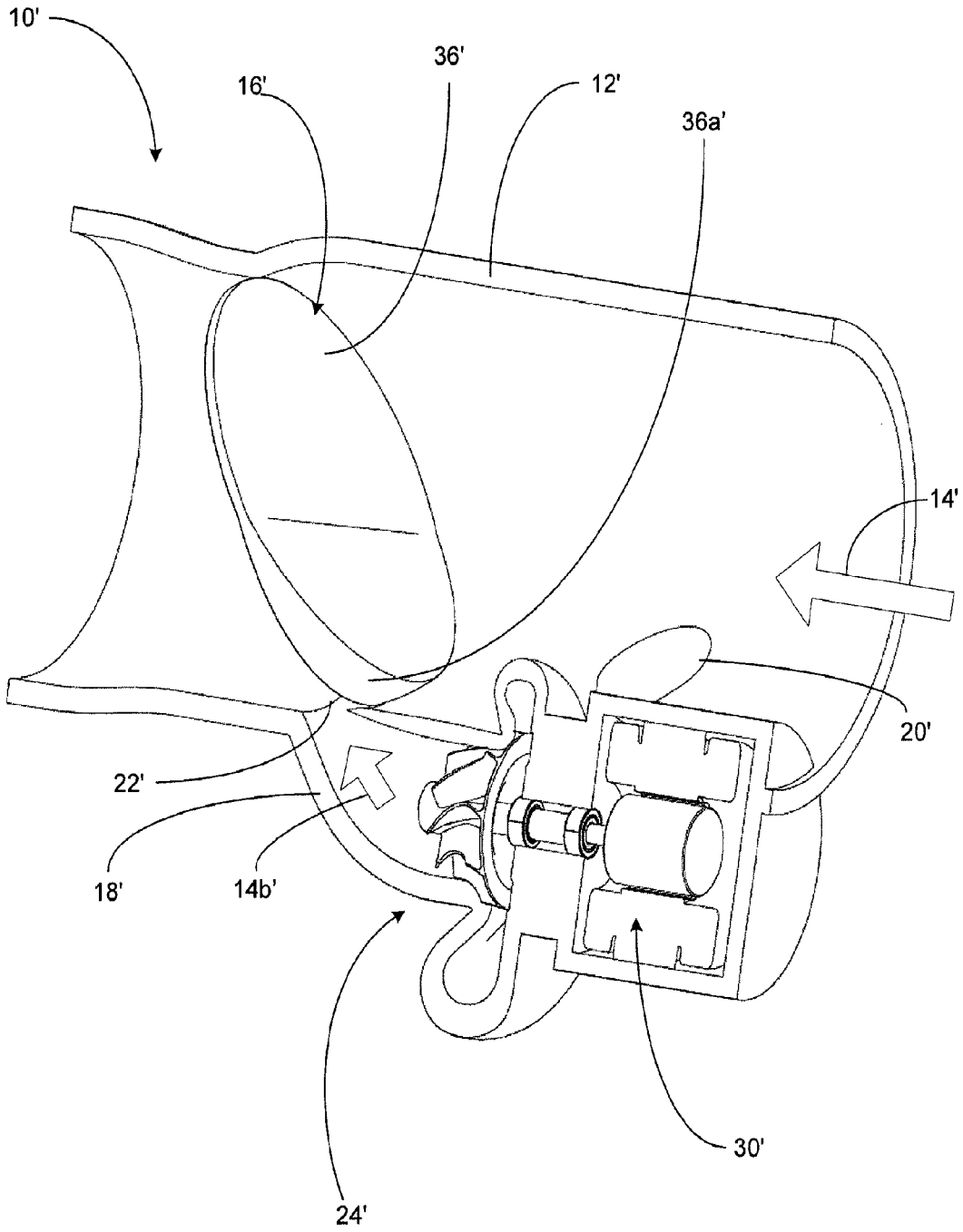
FIG. 8 illustrates a cross-sectional view of the second embodiment of the flow-control assembly of FIG. 6 in the second position wherein the flow-control valve substantially blocks flow of a fluid through the fluid conduit and at least partially unblocks the outlet of the fluid expansion conduit to thereby allow a relatively larger flow of the fluid through the fluid expansion conduit.

FIGS. 7 and 8 illustrates the flow-control assembly 10' when the flow-control valve 16' is configured to a second position wherein the flow-control valve substantially blocks flow 14' of the fluid through the fluid conduit 12' and at least partially unblocks the outlet 22' of the fluid expansion conduit 18' to thereby allow flow 14*a*', 14*b*' of the fluid through the fluid expansion conduit, which enters at the inlet 20'. In FIG. 7 the flow-control valve 16' has only slightly transitioned from the first position to the second position by rotating the throttle plate 36' clockwise, and hence a relatively small flow 14*a*' of the fluid is allowed through the fluid expansion conduit 18'. However, as illustrated, the flow-control assembly 10' substantially blocks flow of the fluid past the flow-control valve 16' through the fluid conduit 12'. In the embodiment illustrated herein, this is accomplished by creating a tight fit between the throttle plate 36' and the fluid conduit 12' in which the flow-control valve 16' is positioned. In particular, in the illustrated embodiment the fluid conduit 12' includes a sealing wall 40' (see FIGS. 6 and 9) which the throttle plate 36' substantially engages when the flow-control valve 16' is in the first position. In order to accommodate rotation of the throttle plate 36', the sealing wall 40' defines a curved profile of substantially the same radius as the throttle plate whereby the throttle plate thus maintains a tight fit with the sealing wall as it rotates to the second position. Further, the throttle plate may include a relatively thicker end 36*a*' (see FIGS. 7 and 8) in some embodiments which maintains contact with the sealing wall 40' as the throttle plate rotates from the first to the second position.

FIG. 8 illustrates the flow-control valve 16' as it has opened further within the second position. Specifically, FIG. 8 illustrates the flow-control valve 16' with the throttle plate 36' rotated within the second position to a point at which the outlet 22' to the fluid expansion conduit 18' is substantially fully unblocked. Accordingly, flow of the fluid through the flow-control assembly 10' may be adjusted to the desired level by adjusting the flow-control valve 16' within the second position. Thus, for example, the arrangement of the flow-control valve 16' in FIG. 8 may allow for a relatively large flow 14*b*' of the fluid through the fluid expansion conduit 18' as compared to the relatively small flow 14*a*' of the fluid allowed by the configuration illustrated in FIG. 7. Further, the second position of the flow-control valve 16', as illustrated in FIGS. 7 and 8 directs substantially all of the flow 14' of the fluid through the fluid expansion conduit 18'. Accordingly, the desired amount of flow of the fluid may be achieved while at the same time using the rotating fluid expander 24' to generate electricity by way of the electrical generator 30' or perform other functions.

Figure 9:
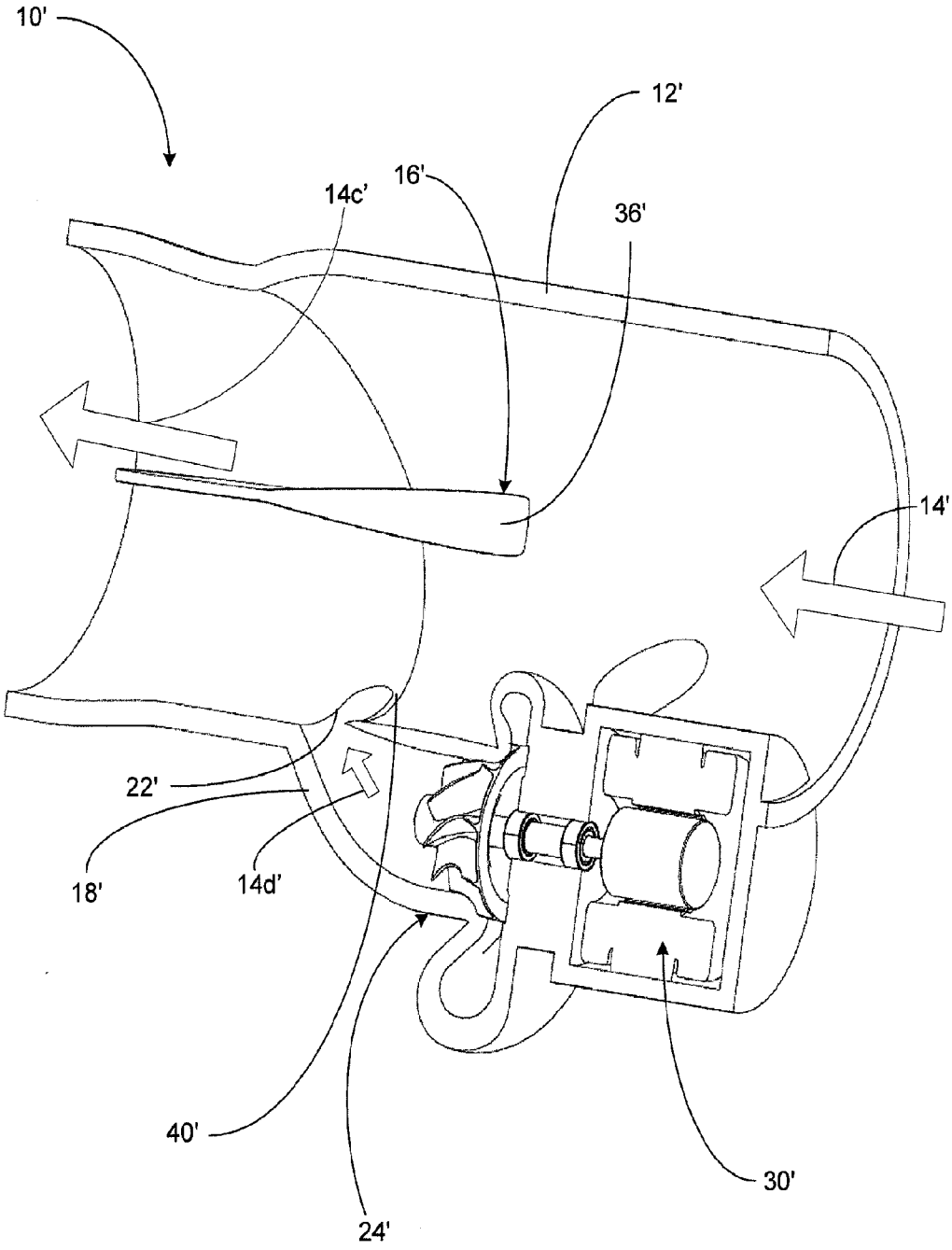
FIG. 9 illustrates a cross-sectional view of the second embodiment of the flow-control assembly of FIG. 6 in a third position wherein the flow-control valve at least partially unblocks the fluid conduit to thereby allow flow of the fluid through the fluid conduit without necessary passing through the fluid expansion conduit.

However, in some instances additional flow of the fluid through the flow-control assembly 10' may be desirable. Accordingly, as illustrated in FIG. 9, the flow-control valve 16' may be configurable to a third position wherein the flow-control valve at least partially unblocks the fluid conduit 12' to thereby allow flow 14' of the fluid through the fluid conduit without necessarily passing through the fluid expansion conduit 18'. In the third position the throttle plate 36' is rotated, clockwise as illustrated, past the outlet 22' of the fluid expansion conduit 18' and out of contact with the sealing wall 40'. This allows a direct flow 14*c*' of the fluid to pass through the flow-control valve 16' via the fluid conduit 12' without traveling through the fluid expansion conduit 18'. However, in some embodiments a bypass flow 14*d*' of the fluid may still travel through the fluid expansion conduit 18' in some instances due to the outlet 22' to the fluid expansion conduit remaining unblocked. Thus, by rotating the throttle plate 36' such that it is substantially parallel with the flow 14' of the fluid, the flow-control valve 16' may allow a maximum flow through the flow-control assembly 10' when the flow-control valve is in the third position.

Thus, operation of the second embodiment of the flow-control assembly 10' is substantially similar to that of the first embodiment of the flow-control assembly 10. Thereby, the second embodiment of the flow-control assembly 10' may be employed in systems such as the system 100 illustrated in FIG. 5 in place of the first embodiment of the flow-control assembly 10. Accordingly, the first embodiment of the flow-control assembly 10 and the second embodiment of the flow-control assembly may be interchangeably used in some embodiments.

FIGS. 10 through 18 illustrate an embodiment of a butterfly bypass valve, comprising a housing 112 defining a bypass flow passage 113 therethrough; a throttle plate 136 disposed in the bypass flow passage, the throttle plate being pivotable about a pivot axis oriented transverse to a flow direction through the bypass flow passage, an outer peripheral edge of the throttle plate being in substantially sealing engagement with a sealing portion 115 of an inner surface of the housing when the throttle plate is in a closed position such that the throttle plate substantially restricts fluid flow through the bypass flow passage, the throttle plate being pivotable to an open position in which portions of the edge of the throttle plate are spaced from the inner surface to allow fluid flow through the bypass flow passage; and a port 122 defined through the housing 112 for allowing a portion of fluid passing through the bypass flow passage 113 to be removed through the port, the edge of the throttle plate 136 restricting fluid flow into the port when the throttle plate is in the closed position, the port being uncovered to allow fluid flow into the port when the throttle plate is pivoted to the open position.

The sealing portion 115 of the inner surface of the housing in substantially sealing engagement with the edge of the throttle plate 136 is configured to allow a predetermined amount of pivoting of the throttle plate toward the open position while maintaining the edge of the throttle plate in substantially sealing engagement with the sealing portion so as to restrict fluid flow through the bypass flow passage 113.

The port 122 is located with respect to the sealing portion 115 such that as the throttle plate 136 is pivoted from the closed position toward the open position, the throttle plate begins to progressively uncover a first part 122*a* of the port to allow fluid flow therethrough while the edge of the throttle plate is still in substantially sealing engagement with the sealing portion 115 restricting fluid flow through the bypass flow passage 113.

In one embodiment, the port 122 is located with respect to the sealing portion 115 such that the throttle plate 136 begins to allow flow through the bypass flow passage 113 before the port is fully uncovered by the throttle plate.

In one embodiment, the first part 122*a* of the port 122 widens in a direction of movement of the edge of the throttle plate (see FIG. 14).

In one embodiment, the first part 122*a* of the port transitions into a second part 122*b* of the port having a generally constant width in the direction of movement of the edge of the throttle plate.

In one embodiment, the second part 122*b* of the port transitions into a third part 122*c* (FIG. 14) of the port that narrows in the direction of movement of the edge of the throttle plate.

In one embodiment, the housing further includes a return passage spaced from the port and extending into the bypass flow passage, through which fluid removed from the bypass flow passage via the port is returned to the bypass flow passage.

In one embodiment, there is a single actuator coupled with the throttle plate and operable for pivoting the throttle plate so as to control flow through both the bypass flow passage and the port.

Many modifications and other embodiments will come to mind to one skilled in the art to which these embodiments pertain having the benefit of the teachings presented in the foregoing descriptions and the associated drawings. Therefore, it is to be understood that modifications and other embodiments are intended to be included within the scope of the appended claims. Although specific terms are employed herein, they are used in a generic and descriptive sense only and not for purposes of limitation.

What is claimed is:

1. A butterfly bypass valve, comprising:

a housing defining a bypass flow passage therethrough;

a throttle plate disposed in the bypass flow passage, the throttle plate being pivotable about a pivot axis oriented transverse to a flow direction through the bypass flow passage, an outer peripheral edge of the throttle plate being in substantially sealing engagement with a sealing portion of an inner surface of the housing when the throttle plate is in a closed position such that the throttle plate substantially restricts fluid flow through the bypass flow passage, the throttle plate being pivotable to an open position in which portions of the edge of the throttle plate are spaced from the inner surface to allow fluid flow through the bypass flow passage; and a port defined through the housing for allowing a portion of fluid passing through the bypass flow passage to be removed through the port, the edge of the throttle plate restricting fluid flow into the port when the throttle plate is in the closed position, the port being uncovered to allow fluid flow into the port when the throttle plate is pivoted to the open position;

wherein said sealing portion of the inner surface of the housing in substantially sealing engagement with the edge of the throttle plate is configured to allow a predetermined amount of pivoting of the throttle plate toward the open position while maintaining the edge of the throttle plate in substantially sealing engagement with the sealing portion so as to restrict fluid flow through the bypass flow passage; and wherein the port is located with respect to the sealing portion such that as the throttle plate is pivoted from the closed position toward the open position, the throttle plate begins to progressively uncover a first part of the port to allow fluid flow therethrough while the edge of the throttle plate is still in substantially sealing engagement with the sealing portion restricting fluid flow through the bypass flow passage, and wherein the port is located with respect to the sealing portion such that the throttle plate begins to allow flow through the bypass flow passage before the port is fully uncovered by the throttle plate.

2. The butterfly bypass valve of claim 1, wherein the first part of the port widens in a direction of movement of the edge of the throttle plate.

3. The butterfly bypass valve of claim 2, wherein the first part of the port transitions into a second part of the port having a generally constant width in the direction of movement of the edge of the throttle plate.

4. The butterfly bypass valve of claim 3, wherein the second part of the port transitions into a third part of the port that narrows in the direction of movement of the edge of the throttle plate.

5. The butterfly bypass valve of claim 1, wherein the housing further includes a return passage spaced from the port and extending into the bypass flow passage, through which fluid removed from the bypass flow passage via the port is returned to the bypass flow passage.

6. The butterfly bypass valve of claim 1, further comprising a single actuator coupled with the throttle plate and operable for pivoting the throttle plate so as to control flow through both the bypass flow passage and the port.

7. A throttle-loss recovery system for an internal combustion engine, comprising:

a turbine/generator unit comprising a turbine connected to an electrical generator, air passing through the turbine being throttled and expanded by the turbine before the air is supplied to an intake of the engine, the turbine driving the generator to produce electrical power; and a butterfly bypass valve arranged in parallel to the turbine of the turbine/generator unit, the valve comprising:

a housing defining a bypass flow passage allowing air destined for the intake to bypass the turbine;

a throttle plate disposed in the bypass flow passage, the throttle plate being pivotable about a pivot axis oriented transverse to a flow direction through the bypass flow passage, an outer peripheral edge of the throttle plate being in substantially sealing engagement with a sealing portion of an inner surface of the housing when the throttle plate is in a closed position such that the throttle plate substantially restricts air flow through the bypass flow passage, the throttle plate being pivotable to an open position in which portions of the edge of the throttle plate are spaced from the inner surface to allow air flow through the bypass flow passage; and a port defined through the housing for allowing a portion of air passing through the bypass flow passage to be removed through the port, the edge of the throttle plate restricting air flow into the port when the throttle plate is in the closed position, the port being arranged to feed air to the inlet of the turbine when the throttle plate is pivoted to uncover the port;

wherein said sealing portion of the inner surface of the housing in substantially sealing engagement with the edge of the throttle plate is configured to allow a predetermined amount of pivoting of the throttle plate toward the open position while maintaining the edge of the throttle plate in substantially sealing engagement with the sealing portion so as to restrict air flow through the bypass flow passage; and wherein the port is located with respect to the sealing portion such that as the throttle plate is pivoted from the closed position toward the open position, the throttle plate begins to progressively uncover a first part of the port to allow air flow therethrough while the edge of the throttle plate is still in substantially sealing engagement with the sealing portion restricting air flow through the bypass flow passage, and wherein the port is located with respect to the sealing portion such that the throttle plate begins to allow flow through the bypass flow passage before the port is fully uncovered by the throttle plate.

8. The throttle-loss recovery system of claim 7 wherein the first part of the port widens in a direction of movement of the edge of the throttle plate.

9. The throttle-loss recovery system of claim 8, wherein the first part of the port transitions into a second part of the port having a generally constant width in the direction of movement of the edge of the throttle plate.

10. The throttle-loss recovery system of claim 9, wherein the second part of the port transitions into a third part of the port that narrows in the direction of movement of the edge of the throttle plate.

11. The throttle-loss recovery system of claim 7, wherein the housing further includes a return passage spaced from the port and extending into the bypass flow passage, the return passage being connected to the exit of the turbine such that air removed via the port and supplied to the turbine is returned to the bypass flow passage after the air has passed through the turbine.

* * * * *